US008240250B2

(12) United States Patent
Boettcher

(10) Patent No.: US 8,240,250 B2
(45) Date of Patent: Aug. 14, 2012

(54) INK PAN SYSTEM FOR A ROTOGRAVURE PRINTING PRESS

(75) Inventor: Steven E. Boettcher, Appleton, WI (US)

(73) Assignee: Flxon Incorporated, Charlotte, NC (US)

( * ) Notice: Subject to any disclaimer, the term of this patent is extended or adjusted under 35 U.S.C. 154(b) by 575 days.

(21) Appl. No.: 12/421,035

(22) Filed: Apr. 9, 2009

(65) Prior Publication Data

US 2010/0258015 A1 Oct. 14, 2010

(51) Int. Cl.
*B41F 31/06* (2006.01)

(52) U.S. Cl. ..... 101/364; 101/350.1

(58) Field of Classification Search ..... 101/364, 101/350.1, 349.1, 348, 157, 155, 154, 153, 101/DIG. 34; 277/543, 546, 549, 562, 551, 277/572

See application file for complete search history.

(56) References Cited

U.S. PATENT DOCUMENTS 2,350,089 A * 5/1944 Behringer ..... 101/157
2,368,500 A 1/1945 Taylor et al.
2,550,454 A 4/1951 Crafts et al.
2,631,532 A * 3/1953 Harless ..... 101/157
2,990,220 A 6/1961 Malone
3,155,037 A 11/1964 Haskin
4,026,210 A 5/1977 Merzagora
4,497,250 A * 2/1985 Dressler ..... 101/350.5
5,706,724 A * 1/1998 Siler ..... 101/153
5,740,735 A 4/1998 Xydias et al.
5,791,248 A * 8/1998 Atkins et al. ..... 101/350.6
5,983,798 A * 11/1999 Iijima et al. ..... 101/365
6,360,660 B1 * 3/2002 Allison, Jr. ..... 101/169
6,640,703 B2 11/2003 Fukumori et al.
7,243,600 B1 7/2007 Boettcher

* cited by examiner

*Primary Examiner* — Judy Nguyen
*Assistant Examiner* — Leo T Hinze
(74) *Attorney, Agent, or Firm* — Hammer & Associates, P.C.

(57) ABSTRACT

An improved ink system for a single pan design of a rotogravure printing press includes: the reservoir enclosing a substantial portion of the gravure cylinder; the intake section bottom having a slope at the bottom of the intake section; an intake port through the bottom of the intake section; an outtake port through the bottom of the outtake section; the outtake section bottom having a slope at the bottom of the outtake section sloping toward the outtake port; a dam release lever connected to the gate and extending outside of the reservoir, a plurality of channels through the vortex promoter; a prewipe bar located between the doctor blade and the vortex promoter; journal port seals located on each side of the gravure cylinder; and an angled doctor blade holder.

16 Claims, 22 Drawing Sheets

INK PAN SYSTEM FOR A ROTOGRAVURE PRINTING PRESS

FIELD OF INVENTION

The instant application relates to an ink pan system for a rotogravure printing press. More specifically, the instant invention relates to an improvement to a single ink pan system for a rotogravure printing press.

BACKGROUND OF THE INVENTION

A rotogravure printing press uses a direct printing process where the ink is transferred directly to a printing surface (e.g. a paper or plastic web) from small cells that are engraved into the surface of a gravure cylinder. The rotogravure printing press typically consists of the gravure cylinder, a doctor blade, an impression roller, and an ink pan system. In operation, the gravure cylinder is rotated in the filled ink pan system and the engraved cells pickup the ink as the gravure cylinder turns. Excess ink is wiped from the gravure cylinder surface by the doctor blade and is returned to the ink pan system. The printing surface (e.g. the paper or plastic web) is pressed onto the gravure cylinder surface by the impression roller, resulting in a direct ink transfer from the inked cells of the gravure cylinder to the printing surface.

The typical ink pan system consists of two pans, an inner pan and an outer pan. Each pan may have a concave shape. The inner pan holds the ink for pickup by the rotating gravure cylinder. The outer pan receives ink from the inner pan via gravity. In operation, the ink is pumped into the inner pan and then drains through small holes in the bottom of the inner pan and/or cascades over the inner pan into the outer pan. The ink drains out of the bottom of the outer pan through an opening into a drain hose and then into an ink sump via gravity.

There are several problems with the foregoing two pan system. Some of the problems include: the amount of ink needed to operate the rotogravure press, the amount of ink left in the ink pan system after operation, the pump pressure needed to sustain the amount of ink in the ink pan system, the amount of man hours needed to clean parts after operation, and the scumming, bubbling, and swirling affect of the ink in front of the gravure cylinder which causes color voids in the print.

U.S. Pat. No. 7,243,600 discloses a single pan system for a rotogravure printing press designed to overcome some of the problems of the two pan system. This single ink pan design has a reservoir and a dam located within the reservoir that divides the reservoir into an intake section and an outtake section. A gate is provided within the dam that, when opened, allows ink in the intake section to be emptied into the outtake section. While the gate is closed, the dam maintains the ink in the intake section up to the height of the dam and any excess ink flows over the dam into the outtake section. This process of removing the excess, or top layer of ink, helps reduce the amount of scumming, bubbling, and the swirling effect that take place in front of the gravure cylinder. In addition, because of the single pan design, less ink is required to run the rotogravure printing press than a two pan system.

Although this single pan design reduces the amount of ink required to operate and helps reduce the amount of scumming, bubbling, and the swirling effect that take place in front of the gravure cylinder, there are several other problems with this single pan system. First, during the printing process ink may splash out of the pan or into the bearings of the gravure cylinder journal. These ink splashes result in wasted ink and require the bearings of the gravure cylinder journal to be replaced frequently. Second, the single ink pan design requires unnecessary pump pressure to pump the ink over the walls of the reservoir into and out of the pan. Third, the gate provided in the dam requires an operator to reach into the pan and manually pull and hold the gate into the open position, which may result in pollution and waste of the ink in the pan. Fourth, the previous design of the gate allowed the gate to be removed from the dam when an operator was merely trying to open the gate. This forces an operator to try and find and fit the gate back into its slot, which adds to the down time of the printing press. Fifth, the vortex promoter at the bottom of the intake section traps ink, or any other liquids (i.e., cleaning fluids), above the vortex promoter in the intake section, thus not allowing the intake section to be completely cleaned. And sixth, the doctor blade setup used on the single pan design required the doctor blade to be replaced frequently, which is an added cost due to the downtime required of the printing press to replace the doctor blade, and the actual costs of the doctor blades themselves.

As a result of the above described problems of the single pan system for a rotogravure printing press, there is clearly a need to improve this single pan design, while still maintaining its advantages over the two pan design, i.e., less ink required and reducing the amount of scumming, bubbling, and the swirling effect that take place in front of the gravure cylinder. Accordingly, there is a need for a single pan system for a rotogravure printing press that: prevents or reduces the possibility for ink to splash from the pan system; seals the bearings of the gravure cylinder journal; provides an intake and an outtake into and out of the pan system that does not require ink to be pumped over the walls of the pan; provides a means for operating the dam gate from the exterior of the pan that allows the gate to be locked in the open position; provides a dam and gate configuration that does not allow the gate to be removed from the dam; provides a modification to the vortex promoter that allows all of the liquid from the intake section to be drained; and makes the doctor blade more efficient and last longer.

The instant invention is designed to provide an ink pan system for a rotogravure printing press that addresses all the problems mentioned above.

SUMMARY OF THE INVENTION

The instant invention includes an improved ink pan system for a rotogravure printing press with a single pan design. The ink pan system includes: the reservoir enclosing a substantial portion of the gravure cylinder; an intake port through the bottom of the intake section; an outtake port through the bottom of the outtake section; a dam release lever connected to the gate and extending outside of the reservoir; a stopping mechanism for preventing said gate from being raised out of said dam; a plurality of channels through the vortex promoter; a pre-wipe bar located between the doctor blade and the vortex promoter; journal port seals located on each side of the gravure cylinder; and an angled doctor blade holder.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 2:
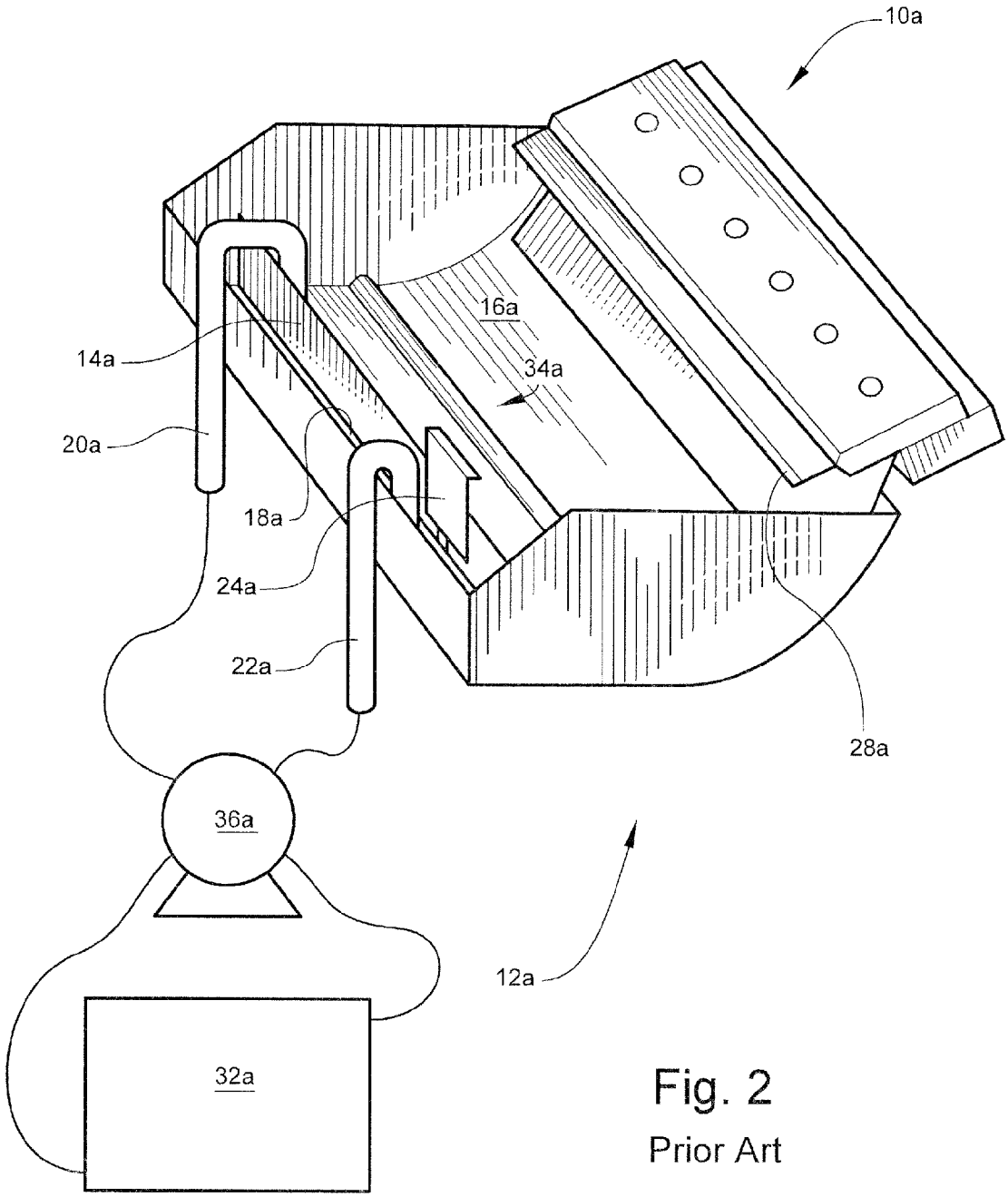
Fig. 2 Prior Art
FIG. 2 is a perspective view of the single ink pan design disclosed in the prior art.
Figure 3:
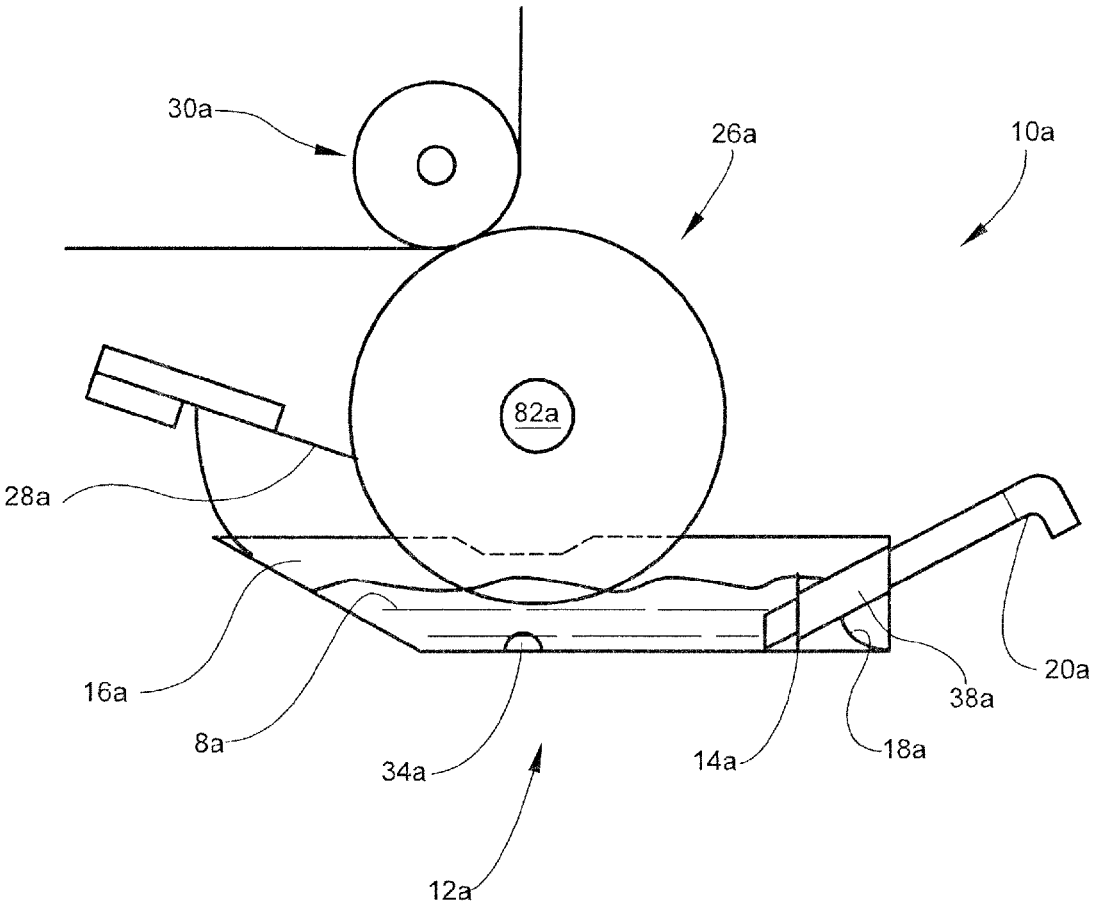
Fig. 3 Prior Art
FIG. 3 is a side view of the single ink pan design disclosed in the prior art.
Figure 4:
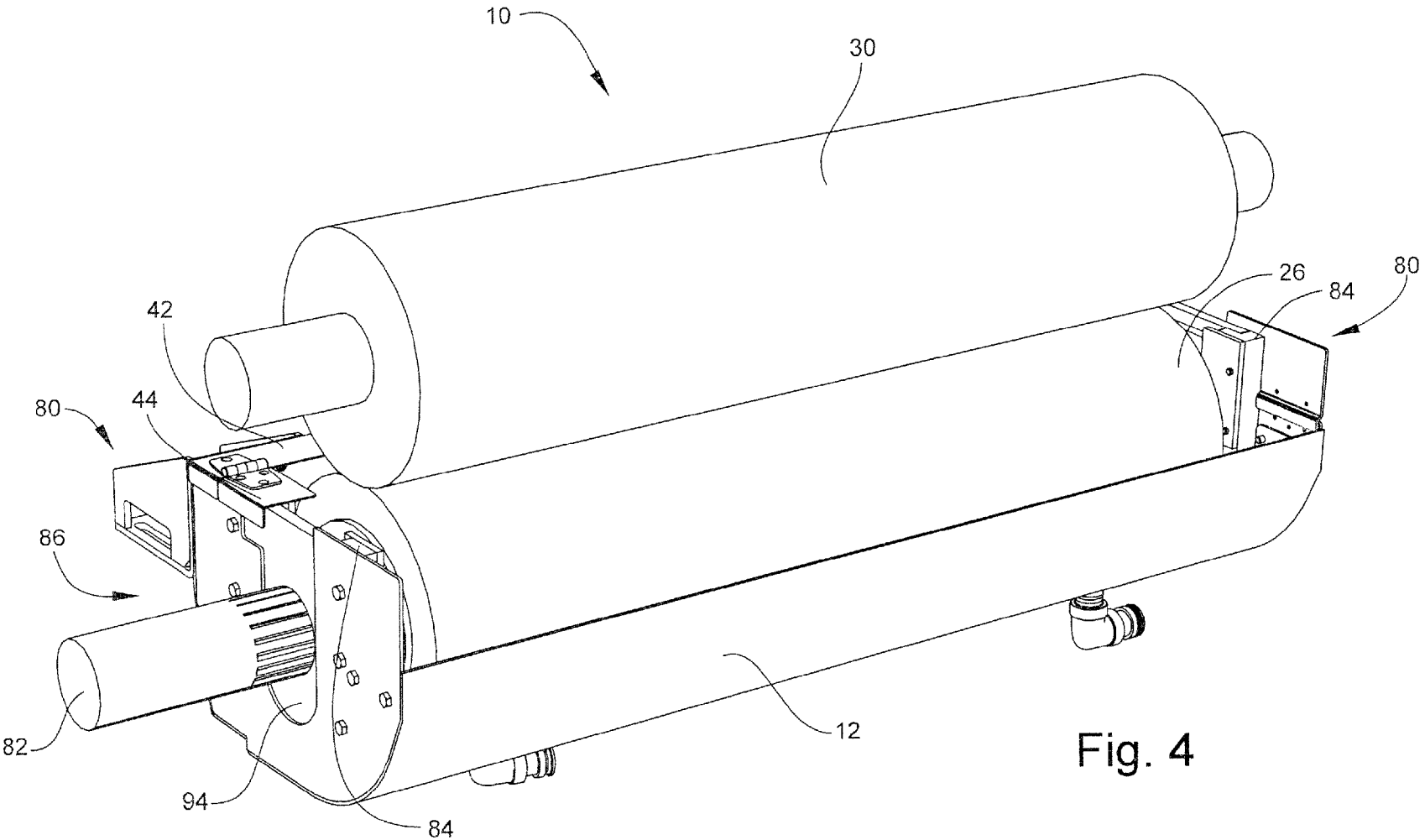
FIG. 4 is another perspective view of the ink pan system from the embodiment shown in FIG. 1.

Referring to FIGS. 2 and 3, wherein like numerals indicate like elements, the previous design of a single pan system 10*a* for a rotogravure printing press is generally shown. The original single pan design 10*a* includes a reservoir 12*a* including a dam 14*a* dividing reservoir 12*a* into an intake section 16*a* and an outtake section 18*a*. Intake section 16*a* may be where the ink is pumped into reservoir 12*a* and may be adapted to allow a gravure cylinder 26*a* to turn within it where the ink within intake section 16*a* may be picked up by the gravure cylinder 26*a*. Outtake section 18*a* may be where ink is pumped out of reservoir 12*a*. Outtake section 18*a* may be adapted to receive ink from intake section 16*a* by either the ink cascading over dam 14*a* or by the ink moving through a gate 24*a* within dam 14*a*. This previous design may include, among other things, the following design problems: ink can easily splash out of reservoir 12*a*; ink is forced to be pumped through inlet 20*a* into intake section 16*a* which forces the ink to be pumped over the side of reservoir 12*a*; ink is forced to be pumped through outlet 22*a* from outtake section 18*a* which forces the ink to be pumped over the side of reservoir 12*a*; there are no seals provided between the journal 82*a* of gravure cylinder 26*a* and reservoir 12*a* allowing ink to splash into the bearings of journal 82*a*; the reservoir 12*a* is very shallow allowing ink to splash out of the reservoir 12*a*; gate 24*a* provided in dam 14*a* requires an operator to reach into reservoir 12*a* and manually pull and hold the gate 24*a* into the open position; gate 24*a* is removable from dam 14*a* when an operator was trying to open gate 24*a*; vortex promoter 34*a* at the bottom of intake section 16*a* traps ink and any other liquids above vortex promoter 34*a* in the intake section, thus not allowing intake section 16*a* to be completely drained; and doctor blade 28*a* can not contact gravure cylinder 26*a* at a 60 degree angle, thus requiring doctor blade 28*a* to be replaced frequently. The following description of the instant embodiment of a single ink pan system for a rotogravure printing press is designed to overcome all of these problems.

Referring to the remaining drawings, wherein like numerals indicate like elements, there is shown in the Figures an embodiment of an ink pan system 10 for a rotogravure printing press. Ink pan system 10 may be a single ink pan design for a rotogravure printing press. Ink pan system 10 may generally comprise a reservoir 12 with an open top. Reservoir 12 may be an open top tank capable of holding an ink. Reservoir 12 may have a dam 14 between an intake section 16 and an outtake section 18. Reservoir 12 is designed to be compatible with any gravure cylinders known in the art, including, but not limited to, gravure cylinders with 18 inches to 32 inch circumferences. Reservoir 12 may include pan shrouding 40 for keeping ink from splashing out of reservoir 12. Ink splashing out of reservoir 12 is obviously a waste of ink, but it may also cause many other costly problems. As examples: ink splashing on to the print surface may cause print defects; additional press down time is required to clean various parts and the floor area surrounding the print station; and additional solvents and cleaning solution are needed to clean the press area between jobs. In one embodiment, reservoir 12 may have a non-stick coating on the interior of the reservoir. This non-stick coating may assist with faster cleanup and ink removal. This non-stick coating may be any non-stick coating, including a Teflon® coating. The non-stick coating may be available from Keco Engineered Coatings, Inc. of Indianapolis Ind.

Figure 1:
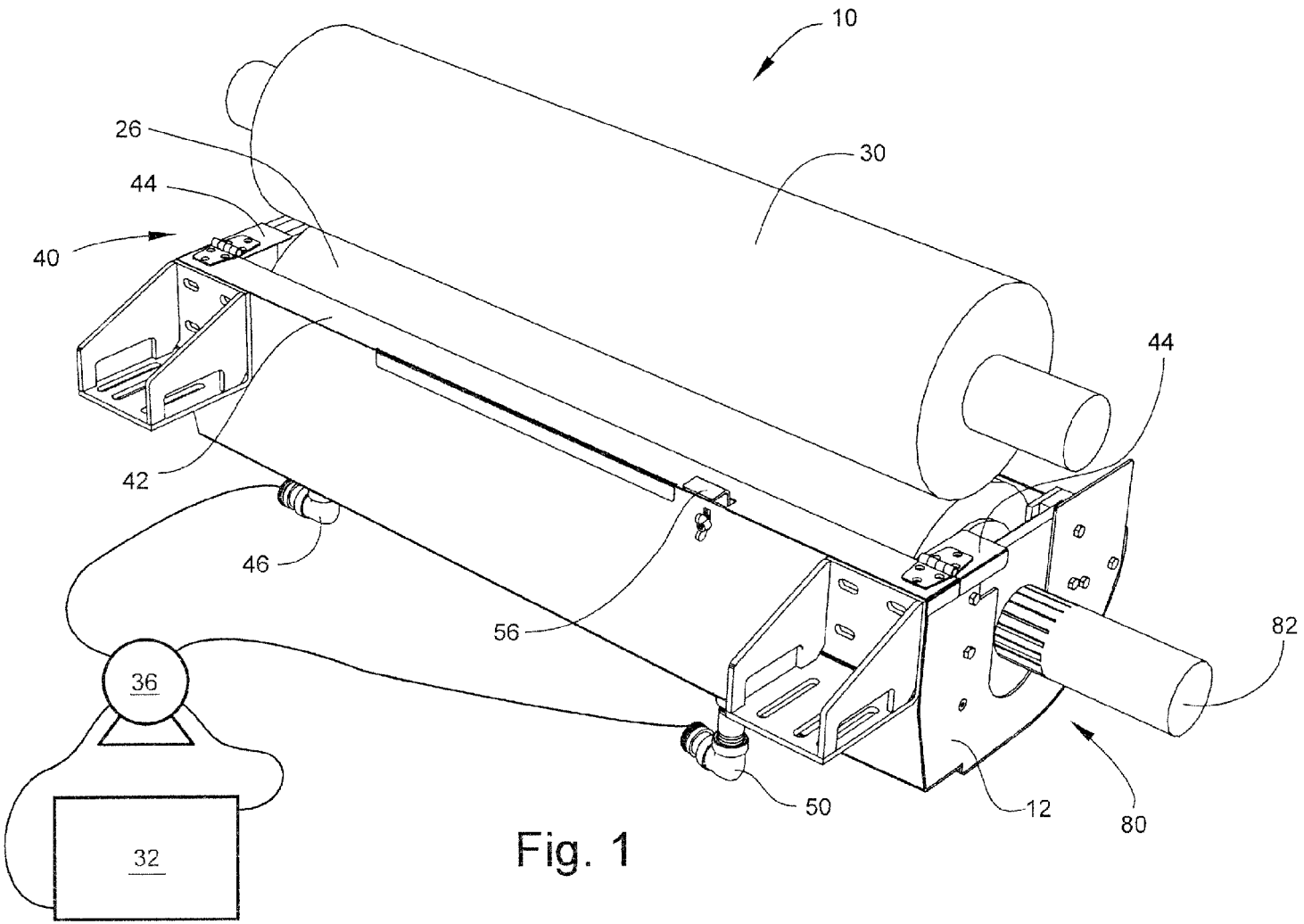
FIG. 1 is a perspective view of one embodiment of the ink pan system according to the instant invention.
Figure 9:
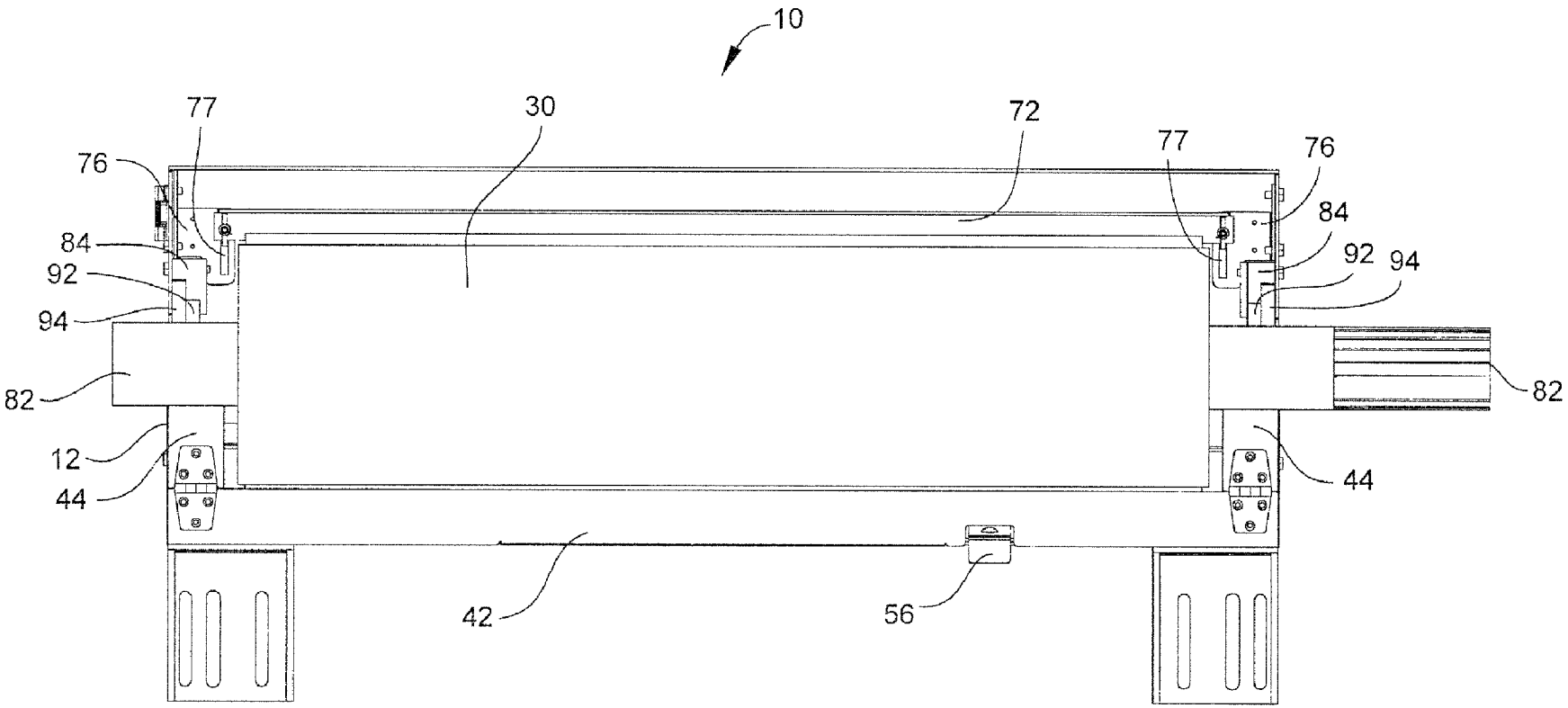
FIG. 9 is a top view of the ink pan system from the embodiment shown in FIG. 1.

Pan shrouding 40 may be included with reservoir 12 (best shown in FIGS. 1 and 9). Pan shrouding 40 may be for enclosing more of gravure cylinder 26 for preventing ink from splashing out of reservoir 12. Preventing ink from splashing out of reservoir 12 may reduce the ink required to run ink pan system 10, thus reducing costs. Pan shrouding 40 may be positioned on the dam side, or the opposite side of doctor blade 28 over outtake section 18. Pan shrouding 40 may include any covers, shrouding, or the like attached to reservoir 12 and around gravure cylinder 26. In one embodiment, pan shrouding 40 may include a dam side shrouding 42 and side flaps 44.

Dam side shrouding 42 may be included as a part of pan shrouding 40 (best shown in FIGS. 1 and 9). Dam side shrouding 42 may be for covering the dam side of reservoir 12 over outtake section 18. Dam side shrouding 42 may be any device capable of covering the dam side of reservoir 12 over outtake section 18. In one embodiment, dam side shrouding 42 may be an L-shaped bracket attached to the top of reservoir 12 over outtake section 18. Dam side shrouding 42 may extend the length of reservoir 12 from the driver side to the operator side over outtake section 18. Dam side shrouding 42 may include a slot adapted to receive dam gate release lever 56.

Figure 10:
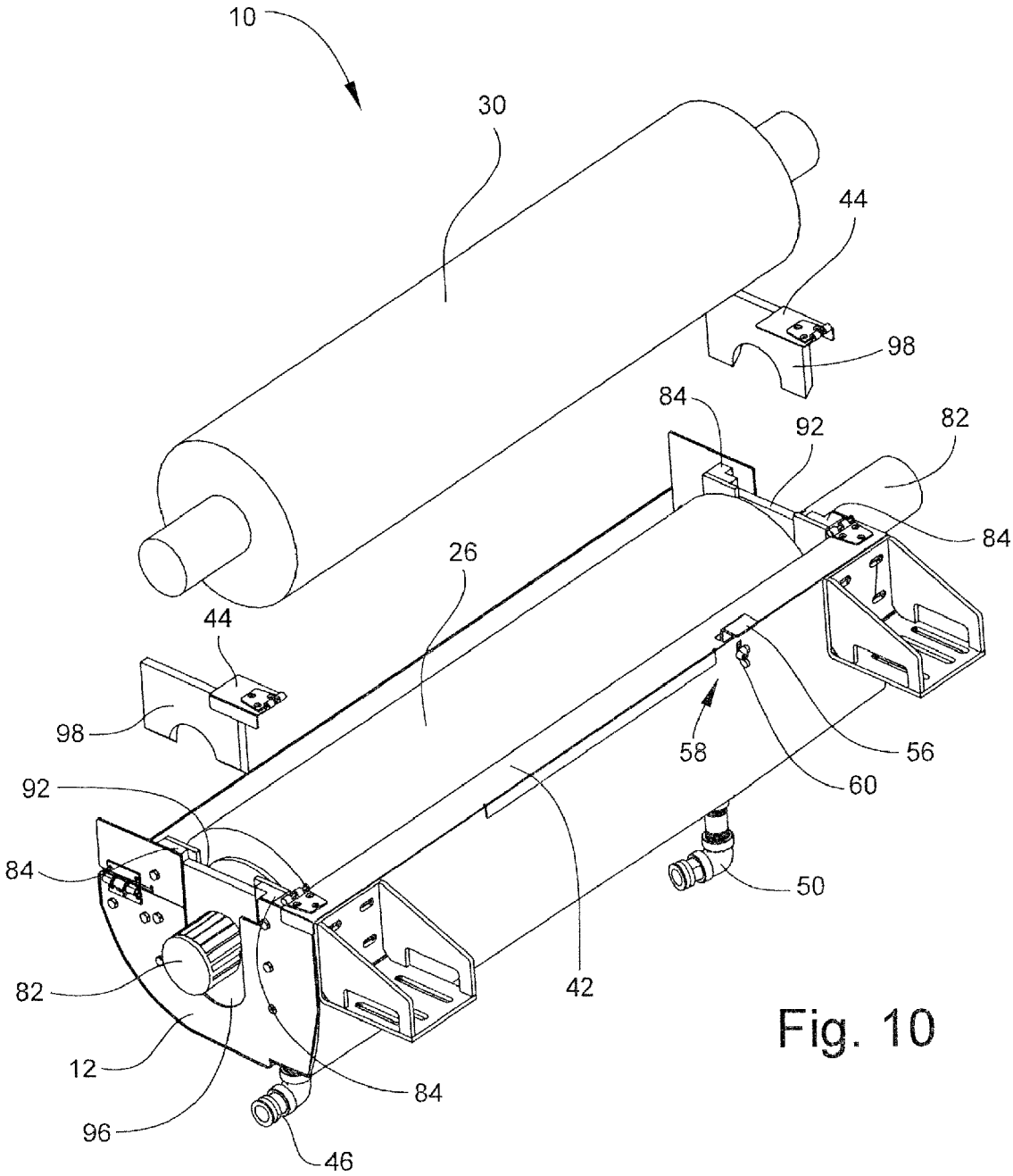
FIG. 10 is a partially disassembled perspective view of the ink pan system from the embodiment shown in FIG. 1.
Figure 11:
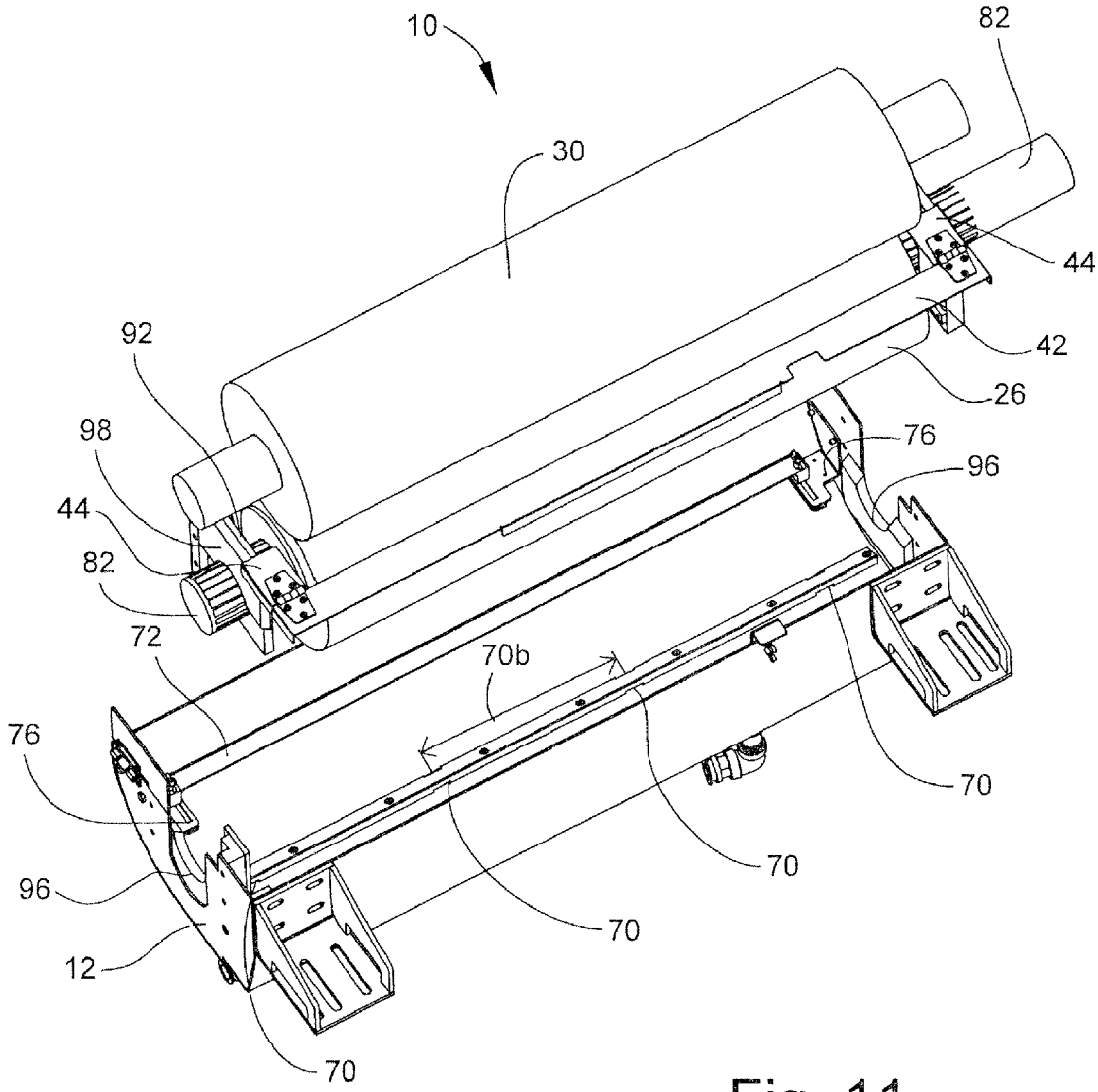
FIG. 11 is another partially disassembled perspective view of the ink pan system from the embodiment shown in FIG. 1.

Side flaps 44 may be included as a part of pan shrouding 40 (best shown in FIGS. 1 and 9). Side flaps 44 may be for covering the ends of reservoir 12 over both ends of the journal 82. Side flaps 44 may be any device capable of covering the ends of reservoir 12 over both ends of the journal 82. In one embodiment, side flaps 44 may be connected to dam side shrouding 42. In this embodiment, side flaps 44 may include a hinged portion (best shown in FIGS. 9 and 10). This hinged portion of side flaps 44 may allow journal 82 (along with journal port seals 80) to be inserted and removed from reservoir 12 more easily.

In the previous single pan design as shown in FIG. 2, a substantial portion of gravure cylinder 26*a* is not enclosed. The previous design clearly encloses much less than 40% of the gravure cylinder. In the current design of ink pan system 10, the combination of pan shrouding 40, doctor blade 28 on the opposite side of the pan shrouding (including an ink diverter 106), and the depth of reservoir 12, may allow ink pan system 10 to enclose a majority of gravure cylinder 26. In one embodiment, ink pan system 10 may enclose greater than 40% of the gravure cylinder. In another embodiment, reservoir 12 may enclose greater than 70% of the gravure cylinder. In yet another embodiment of ink pan system 10, reservoir 12 may enclose approximately 90% of the gravure cylinder. These enclosures allow far more of the surface area of gravure cylinder 26 to be shrouded or covered. As a result, far less solvent may evaporate from the surface of ink pan system 10 and from the surface of gravure cylinder 26. Less evaporation allows the ink to remain stable for a greater period of time during a press run. In addition, print defects, such as color variation may be reduced or eliminated. Furthermore, because of the greater enclosure of gravure cylinder 26, ink pan system 10 may reduce or eliminate contaminants like dust entering the ink, which will reduce print defects.

Figure 19:
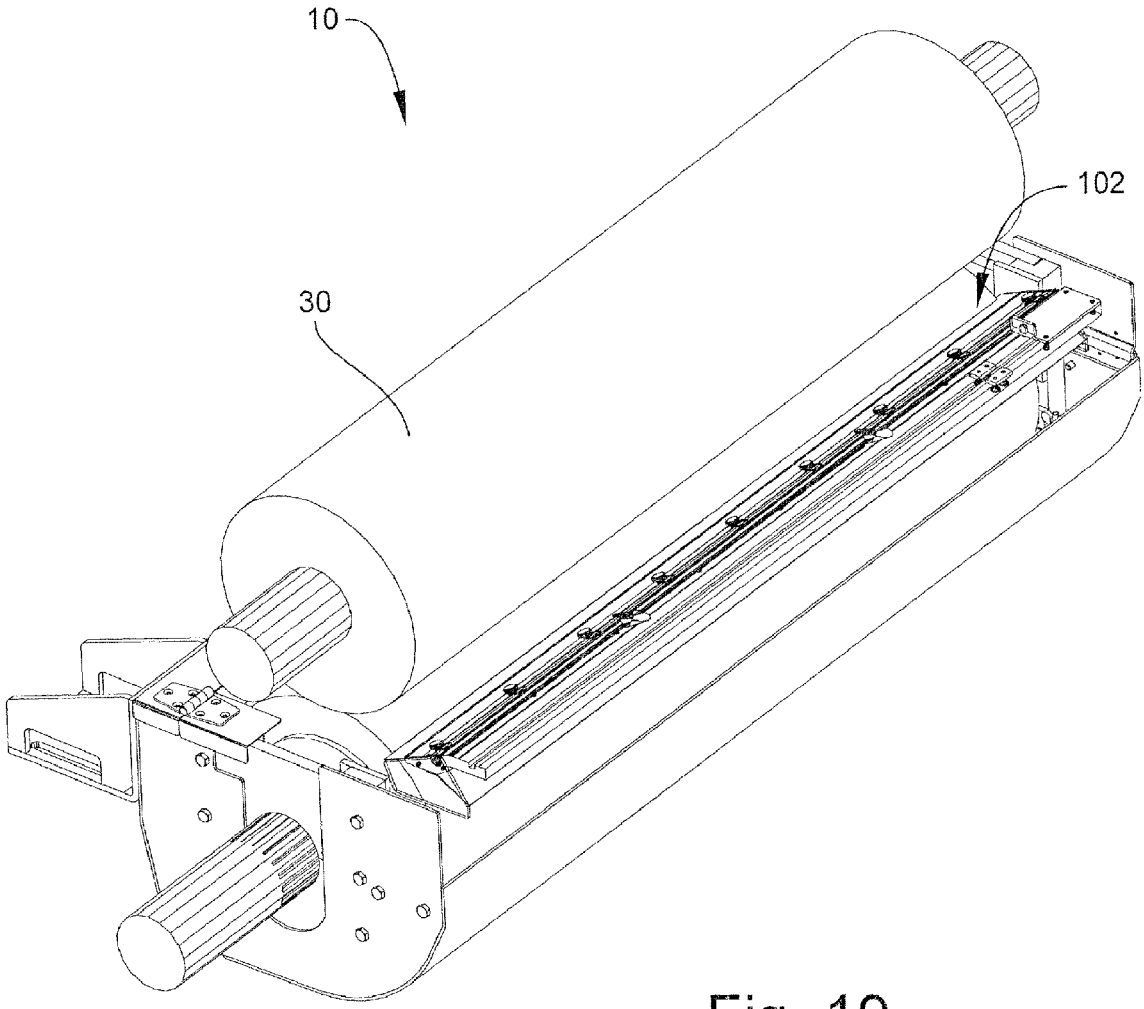
FIG. 19 is a perspective of the ink pan system shown in FIG. 1 with the angled doctor blade holder positioned against the gravure cylinder according to the instant invention.
Figure 20:
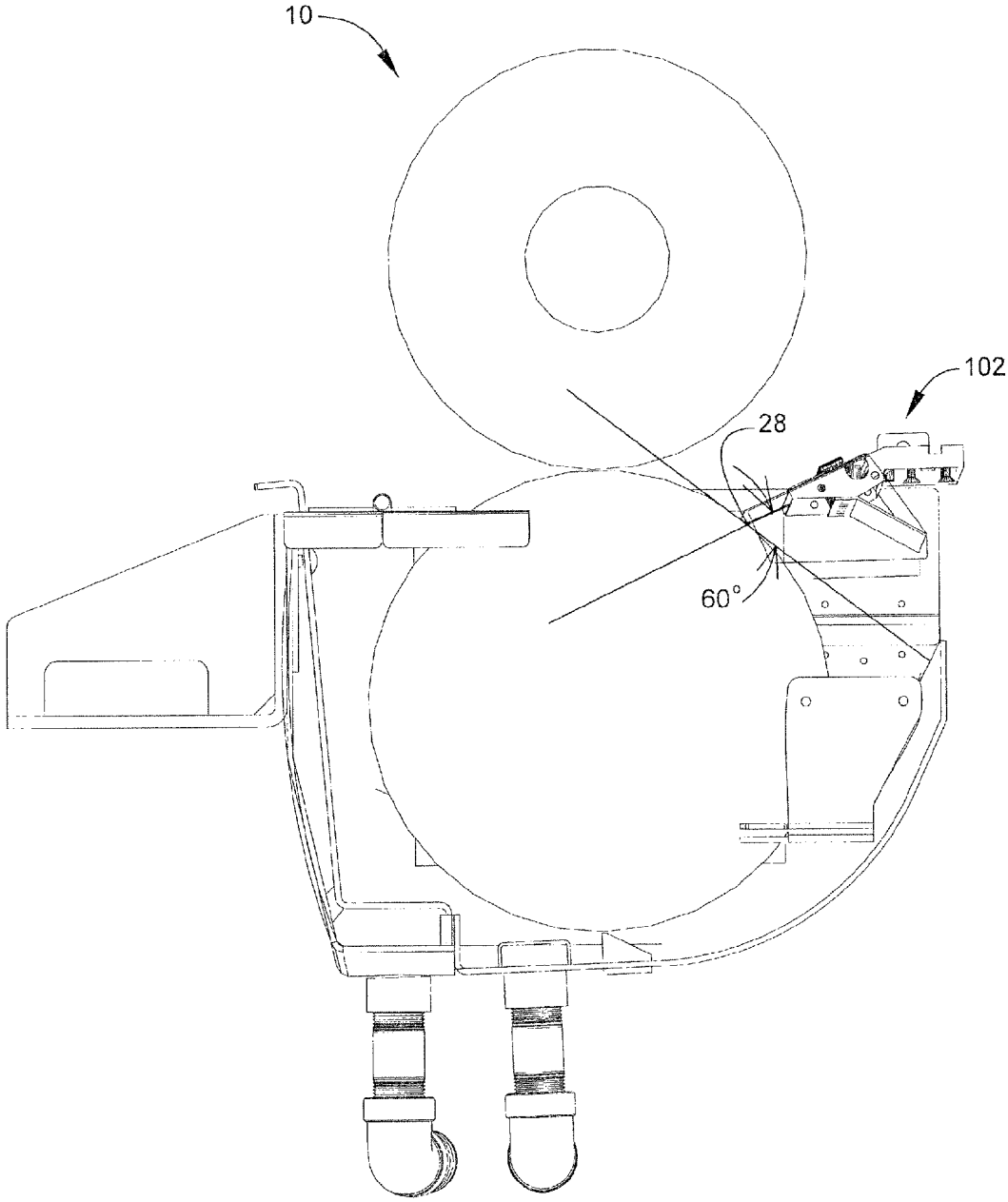
FIG. 20 is a cross-sectional view of the ink pan system shown in FIG. 1 from the inside of the ink pan system of the drive side end including the angled doctor blade holder.
Figure 21:
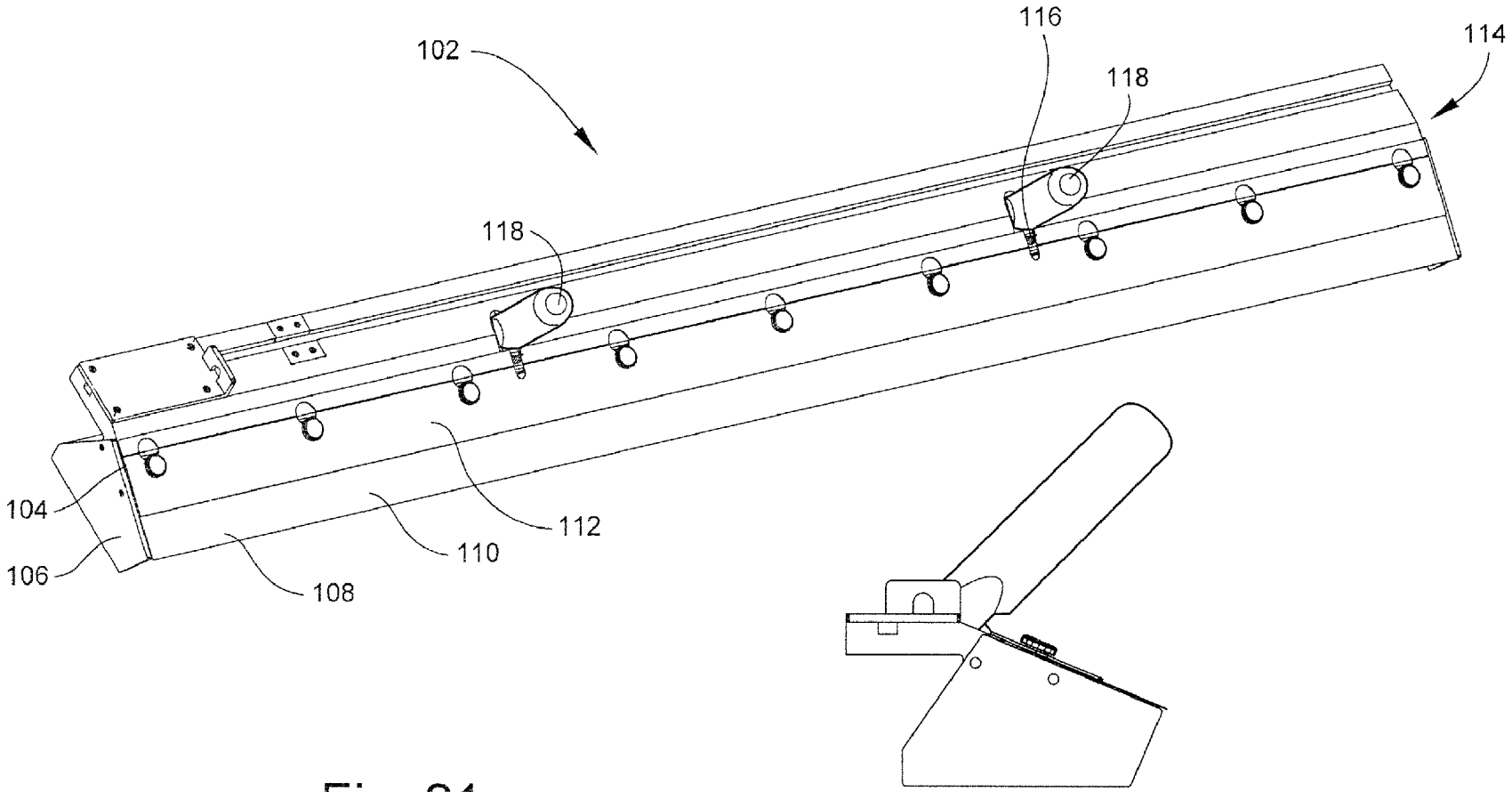
FIG. 21 is a perspective view of the angled doctor blade holder according to the instant invention.
Figure 22:
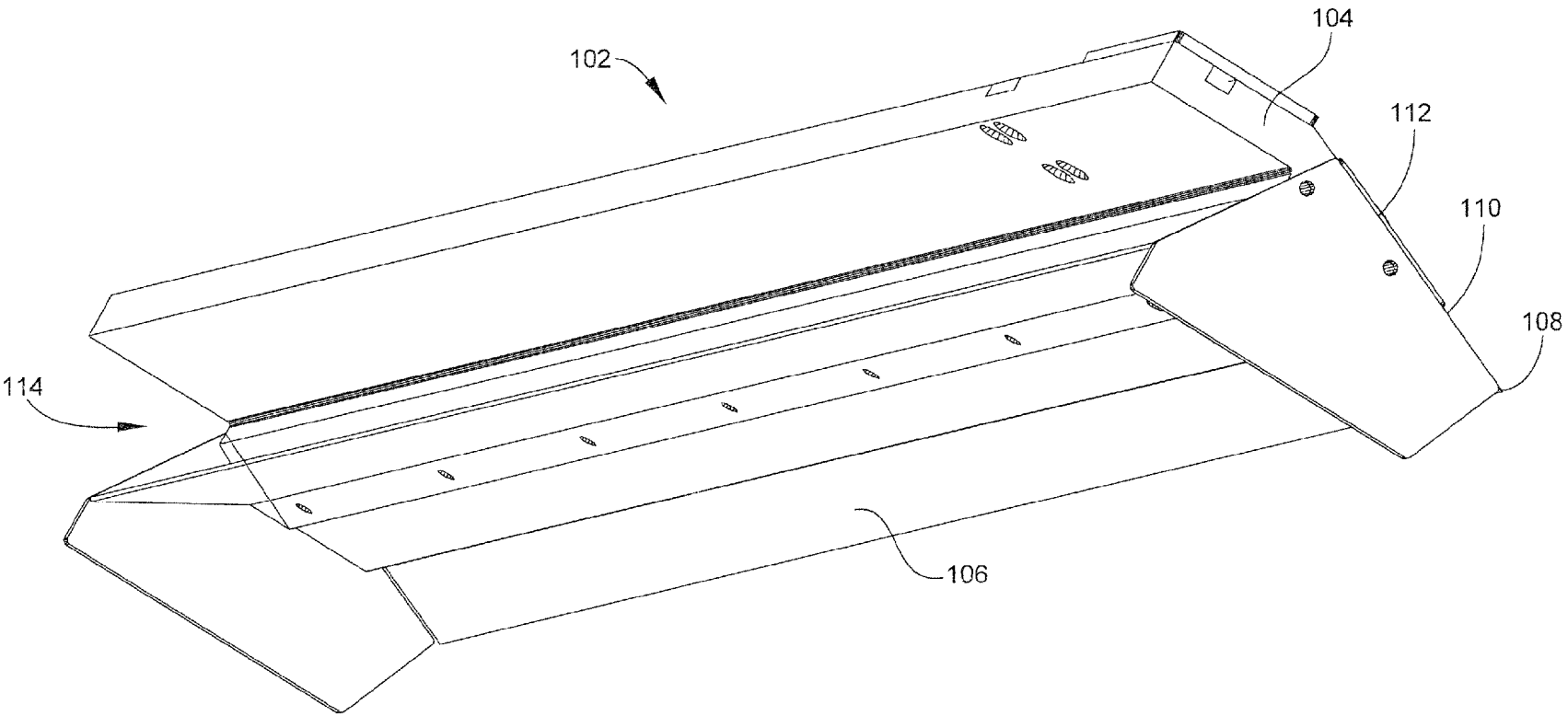
FIG. 22 is another perspective view of the angled doctor blade holder according to the instant invention.
Figure 23:
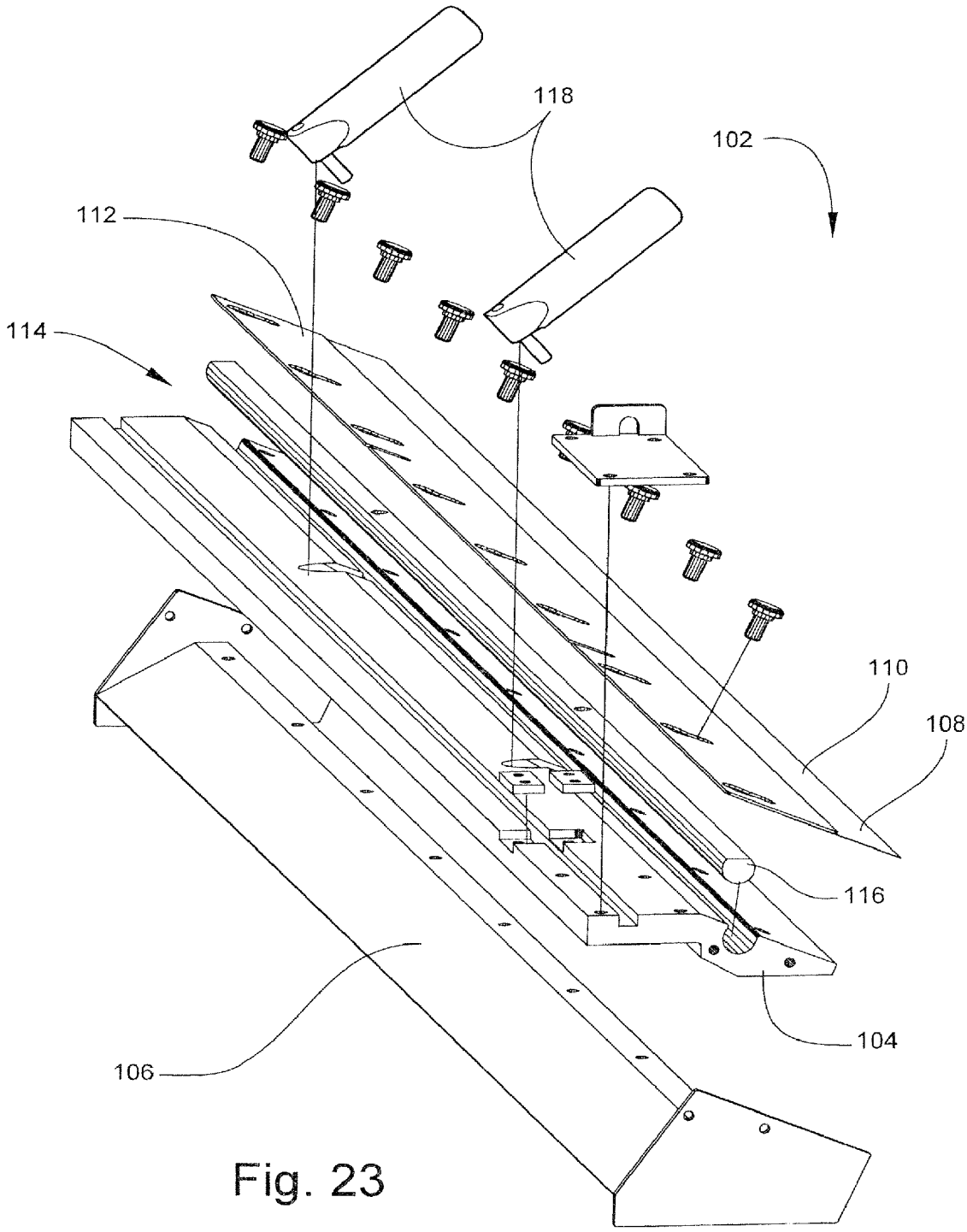
FIG. 23 is a disassembled perspective view of the angled doctor blade holder according to the instant invention.

Intake section 16 may be adapted to allow gravure cylinder 26 to turn within it where ink 8 within intake section 16 may be picked up by the gravure cylinder 26. See FIG. 12. Intake section 16 may have a greater volume than outtake section 18 allowing gravure cylinder 26 to rotate within intake section 16. Intake section 16 may be adapted to receive the excess ink removed from gravure cylinder 26 by a doctor blade 28 (seen in FIGS. 19-20) and a pre-wipe bar 72. Intake section 16 may include an intake port 46 entering through the bottom of intake section 16.

Figure 13:
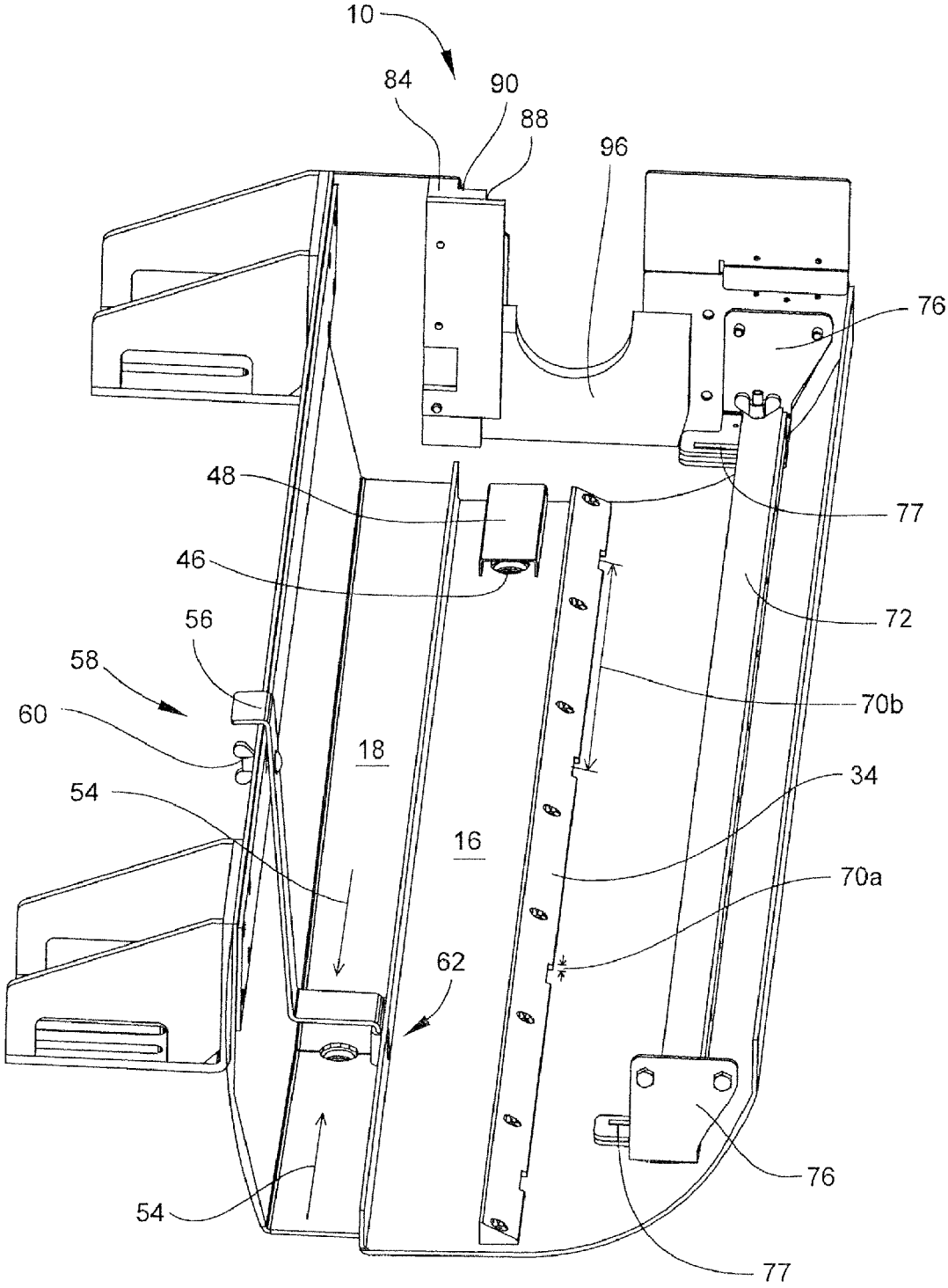
FIG. 13 is a partial view of the ink pan system from the embodiment shown in FIG. 1 from the inside with the gravure cylinder and impression roller removed.
Figure 14:
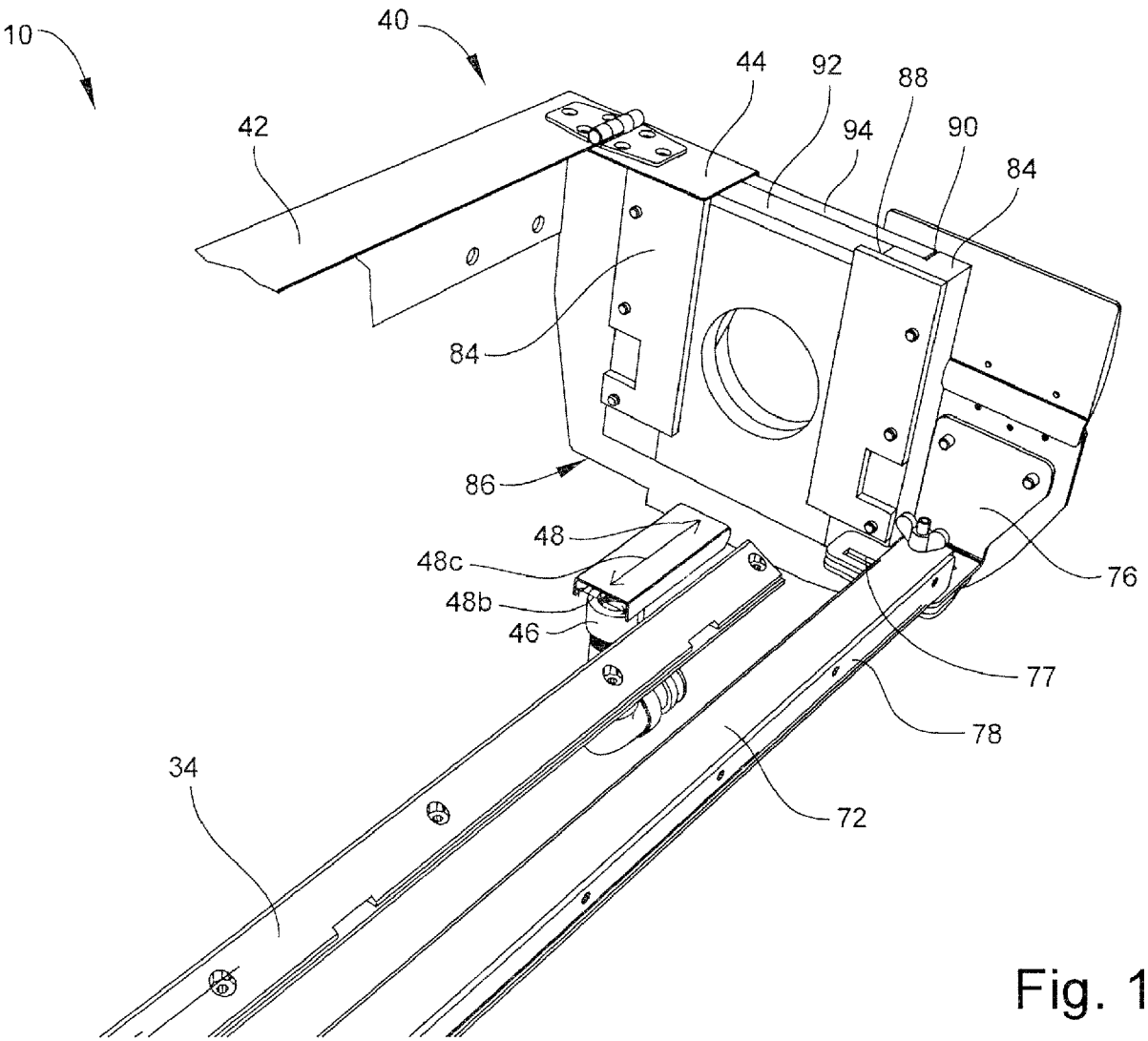
FIG. 14 is another partial view of the inside of the ink pan system from the embodiment shown in FIG. 1.
Figure 15:
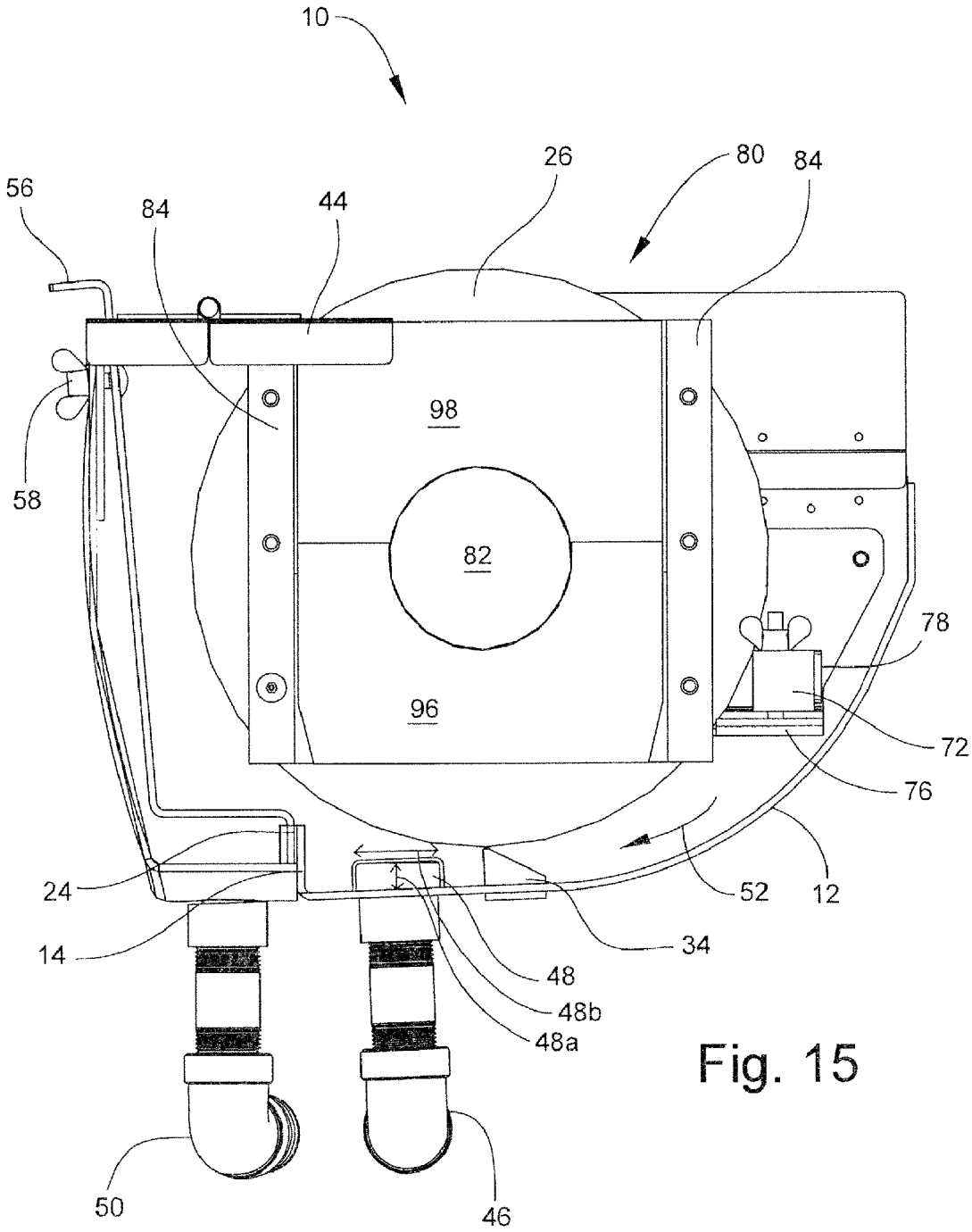
FIG. 15 is a cross-sectional view of the drive side end of the ink pan system from the inside of the ink pan system.

Intake port 46 may be included in the bottom of intake section 16 (best shown in FIGS. 13-15). Intake port 46 may be for providing ink into intake section 16. Intake port 46 may be any port or opening through the bottom of intake section 16 capable of allowing ink to enter intake section 16. Intake port 46 may include a housing 48 positioned over intake port 46. Intake port 46 may be located anywhere in the bottom of intake section 16. In one embodiment, intake port 46 may be located approximate to the drive side of gravure cylinder 26 and approximate to dam 14. In one embodiment, intake port 46 may be an opening with a circular cross-section in the bottom of intake section 16. This circular opening of intake port 46 may have a diameter 46*a* which may be any diameter, including but not limited to, 1 inch.

Housing 48 may be included over intake port 46 in intake section 16 (best shown in FIGS. 13-15). Housing 48 may be for preventing surging of the incoming ink in intake section 16 from intake port 46. Preventing surging of the ink into intake section 16 may assures adequate circulation of the ink and may prevent solid components of the ink from separating and settling. Housing 48 may be any device capable of preventing incoming ink from surging into intake section 16 from intake port 46. In one embodiment, housing 48 may be a rectangular shaped housing with an open end perpendicular to the flow of ink entering intake port 46. This may force the ink to flow out of the housing in a perpendicular direction to the way it enters intake section 16. This rectangular shaped housing may have a height 48*a*, a width 48*b*, and a length 48*c*. Height 48*a* may be any height including 0.5 inches. Width 48*b* may be any width including 1.5 inches. Length 48*c* may be any length including 3 inches. In one embodiment, housing 48 may make use of the side of reservoir 12 as one of its walls.

Outtake port 50 may be included in the bottom of outtake section 18 (best shown in FIGS. 1, 12-13 and 15). Outtake port 50 may be for removing ink from outtake section 18. Outtake port 50 may be any port or opening through the bottom of outtake section 18 capable of allowing ink to be removed from outtake section 18. In one embodiment, outtake port 50 may be an opening with a circular cross-section in outtake section 18. This circular opening of outtake port 50 may have a diameter 50*a*, which may be any diameter, including but not limited to, 1 inch. In one embodiment, outtake port 50 may be located approximate to the operator side of gravure cylinder 26 and approximate to gate 24. Providing outtake port 50 approximate to gate 24 may allow the ink to flow more directly from intake section 16 into outtake port 50. Outtake port 50 should be located as close to the operator side wall of reservoir 12 while avoiding interference between the drain pipe and the cart or trolley.

Figure 5:
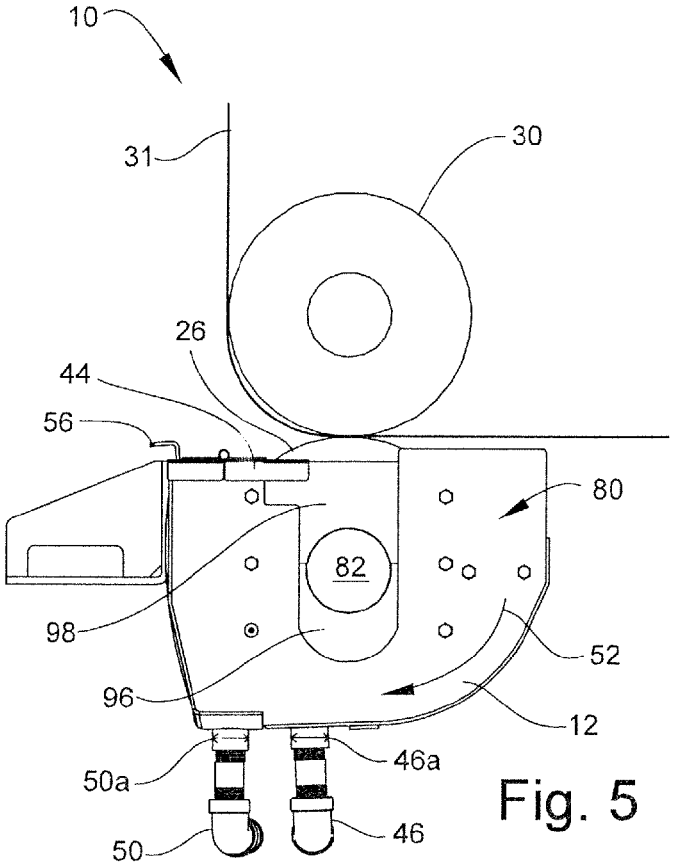
FIG. 5 is a side view of the pan of the ink pan system from the embodiment shown in FIG. 1 from the operator side.
Figure 6:
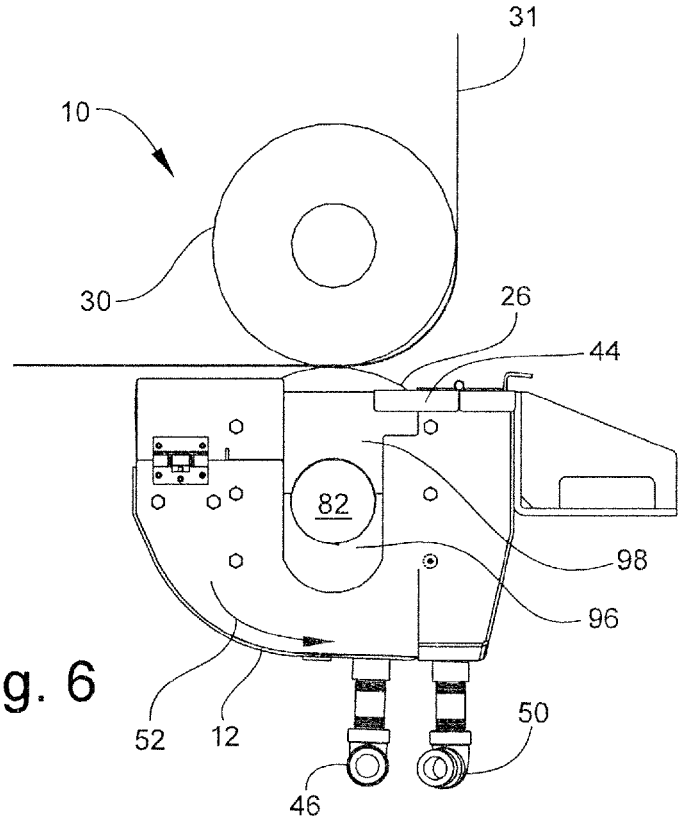
FIG. 6 is another side view of the pan of the ink pan system from the embodiment shown in FIG. 1 from the drive side.
Figure 7:
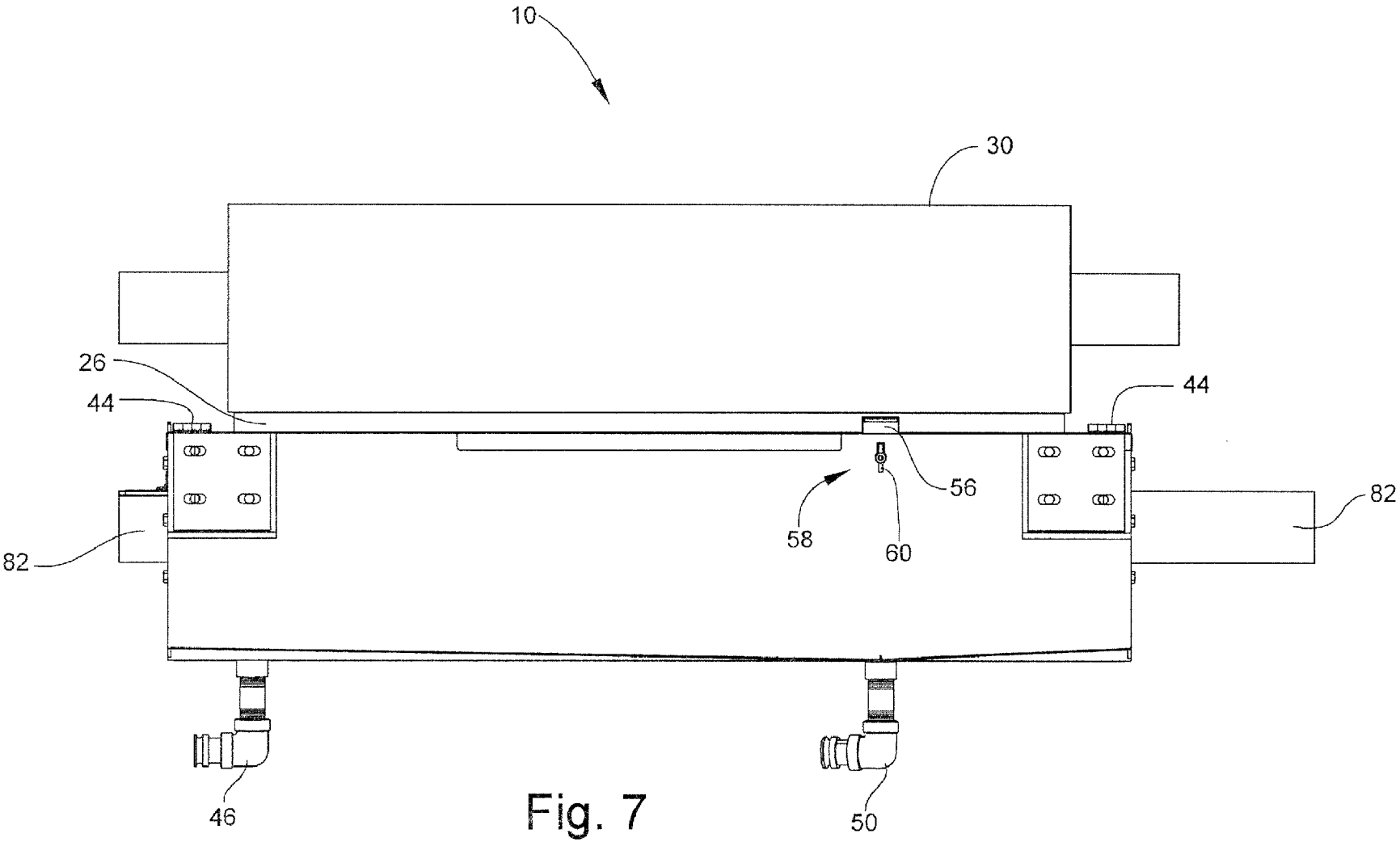
FIG. 7 is another side view of the pan of the ink pan system from the embodiment shown in FIG. 1 from the dam side.
Figure 8:
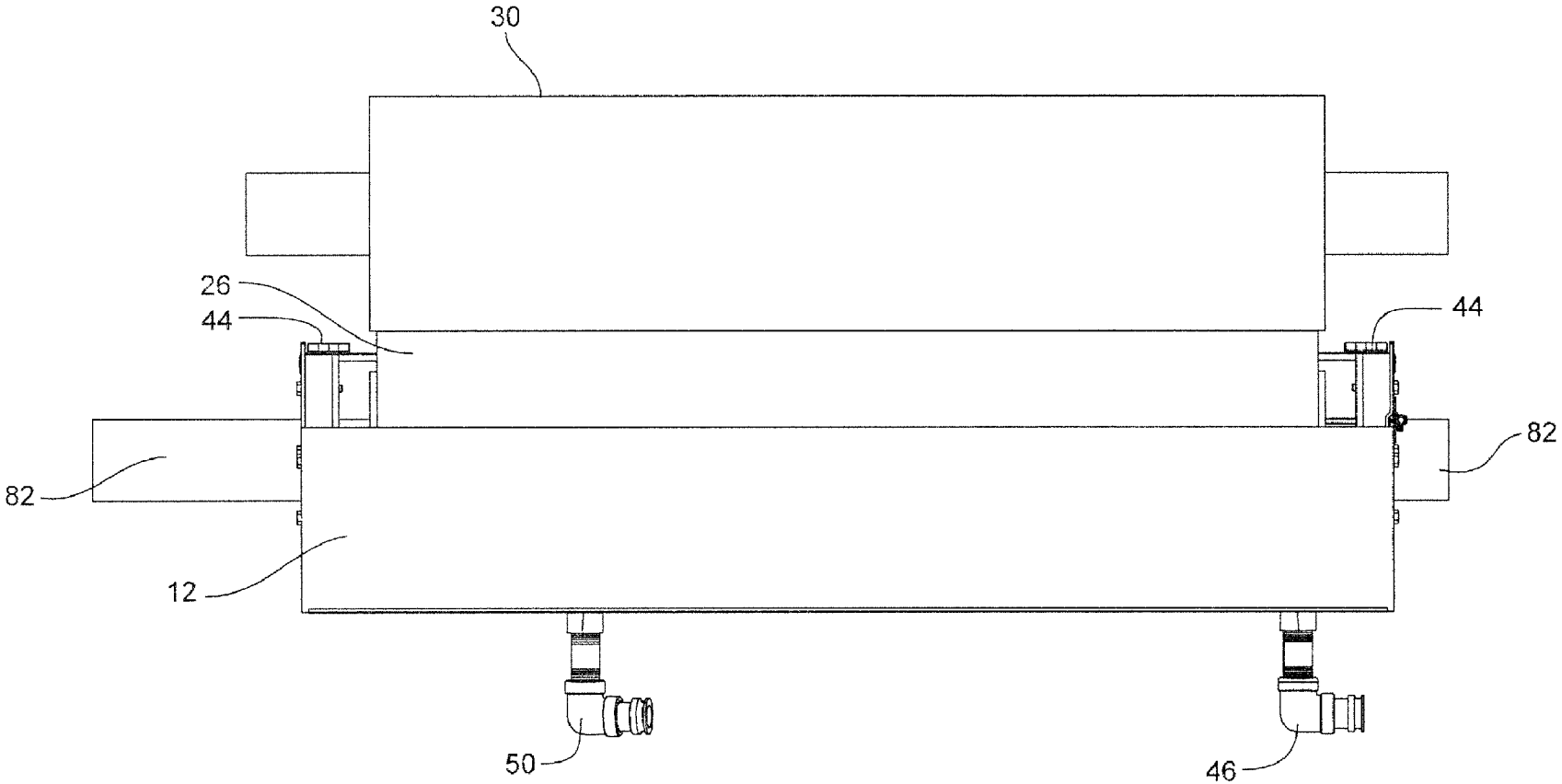
FIG. 8 is another side view of the pan of the ink pan system from the embodiment shown in FIG. 1 from the blade side.

A first slope 52 may be included in intake section 16 (best shown in FIGS. 5-6 and 15). First slope 52 may be for forcing ink in intake section 16 to flow towards outtake section 18. First slope 52 may be any degree of slope. In one embodiment, first slope 52 may be a curved slope at from the sides of reservoir 12 to dam 14. First slope 52 may have a slope of 2 degrees as it approaches vortex promoter 34.

A second slope 54 may be included in outtake section 18 (best shown in FIG. 13). Second slope 54 may be for forcing ink in outtake section to flow toward outtake port 50. In one embodiment, second slope 54 may be toward outtake port 50 from both sides of reservoir 12.

Figure 12:
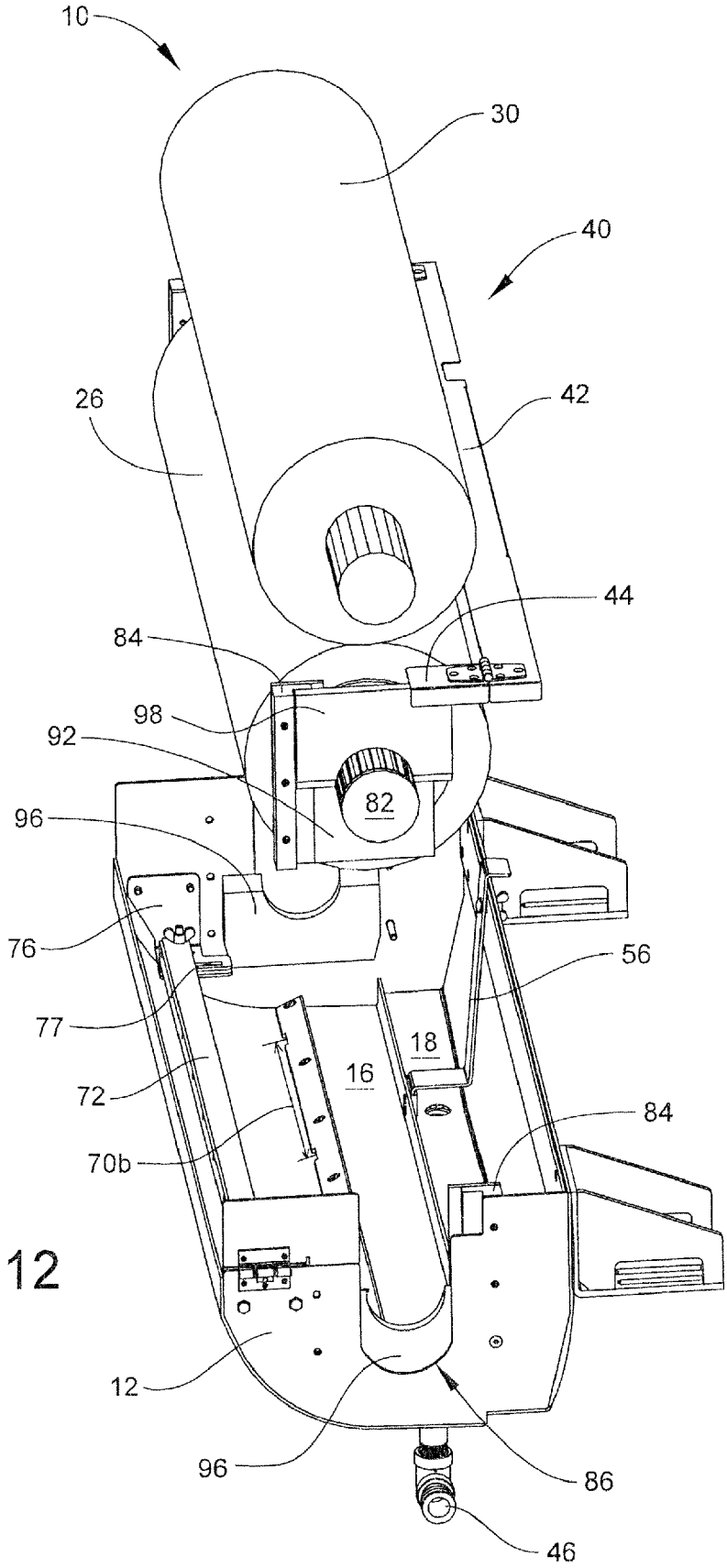
FIG. 12 is another partially disassembled perspective view of the ink pan system from the embodiment shown in FIG. 1.

Dam 14 may divide intake section 16 from outtake section 18 (best shown in FIGS. 12-13). Dam 14 may be adapted to maintain the ink in intake section 16 up to the height of dam 14. Dam 14 may be any structure capable of dividing intake section 16 from outtake section 18. Dam 14 may be a wall within reservoir 12. Dam 14 may include gate 24.

Gate 24 may be a gate within dam 14 (best shown in FIGS. 12-15). Gate 24 may have an open position and a closed position. Gate 24 may be in the open position when the ink (or other liquid) in intake section 16 may empty into outtake section 18. Gate 24 may be in the closed position when the ink (or other liquid) in intake section 16 may be maintained in intake section 16 up to the height of dam 14. Gate 24 may be any gate capable of opening and closing. In one embodiment, gate 24 may be a gate that is opened by sliding vertically upward and may be closed by sliding vertically downward. Gate 24 may include a dam gate release lever 56. Gate 24 may also include a stopping mechanism 62.

Dam gate release lever 56 may be included with gate 24 (best shown in FIGS. 1 and 12-13). Dam gate release lever 56 may be for providing a means to open and close gate 24 from outside of reservoir 12. Dam gate release lever 56 may be any device capable of opening and closing gate 24 from outside of reservoir 12. In one embodiment, dam gate release lever 56 may be a z-shaped bar connected to gate 24 and extending outside of reservoir 12. Dam gate release lever 56 may include a locking means 58.

Locking means 58 may be included with gate 24 (best shown in FIGS. 1 and 12-13). Locking means 58 may be for locking, or holding gate 24 up, in the open position. Locking means 58 may be any device capable of locking, or holding gate 24 up in the open position. Locking means 58 may also be utilized for locking gate 24 in the closed position. In one embodiment, locking means 58 may be a wing nut mechanism 60. Wing nut mechanism 60 may be inserted through a slot in dam gate release lever 56 and a hole in the top of reservoir 12. Wing nut mechanism 60 may be tightened to secure dam gate release lever 56 to reservoir 12. Wing nut mechanism 60 may hold gate 24 in the open or closed position.

A stopping mechanism 62 may be included with gate 24 and dam 14 (best shown in FIGS. 12 and 13). Stopping mechanism 62 may be for preventing gate 24 from being pulled or raised out of dam 14. Stopping mechanism 62 may be any device capable of preventing gate 24 from being pulled or raised out of dam 14. In one embodiment, stopping mechanism 62 may include a closed slot in dam 14, and a rivet extending out from gate 24. In this embodiment, the rivet may be inserted into the closed slot, where the rivet is not allowed to leave the closed slot, thereby, preventing gate 24 from being raised or pulled out of dam 14. In another embodiment, wing nut mechanism 60 may be utilized as stopping mechanism 62.

A vortex promoter 34 may be located within reservoir 12 (best shown in FIGS. 11-15). Vortex promoter 34 may be for creating turbulence in the ink between reservoir 12 and gravure cylinder 26. Vortex promoter 34 may be located below dead center of gravure cylinder 26. Vortex promoter 34 may be any apparatus capable of causing turbulence in the ink between reservoir 12 and gravure cylinder 26. In one embodiment, vortex promoter 34 may be a rounded strip within reservoir 12 that is attached to the bottom surface of reservoir 12 in intake section 16. In another embodiment, vortex promoter 34 may be a bar with a triangular cross-section attached to the bottom surface of reservoir 12 in intake section 16. The improvement to the vortex promoter 34 over the prior art vortex promoter 34*a* (shown in FIGS. 2-3), is the addition of a plurality of channels 68 located within vortex promoter 34.

Plurality of channels 70 may be located through the bottom of vortex promoter 34 (best shown in FIGS. 11-14). Plurality of channels 70 may be for allowing ink to flow under or through vortex promoter 34 towards outtake section 18. Plurality of channels 70 may be any channels or openings through the bottom of vortex promoter 34 that allows ink to flow under vortex promoter 34. In one embodiment, plurality of channels 70 may be machined into the bottom of vortex promoter 34. Groves 70 may have a height 70*a* and a spacing 70*b*. Height 70*a* may be any height, including, but not limited to, approximately 0.125 inches. Spacing 70*b* may be any random or constant spacing, including, but not limited to, a constant spacing of no less than 6 inches.

Figure 16:
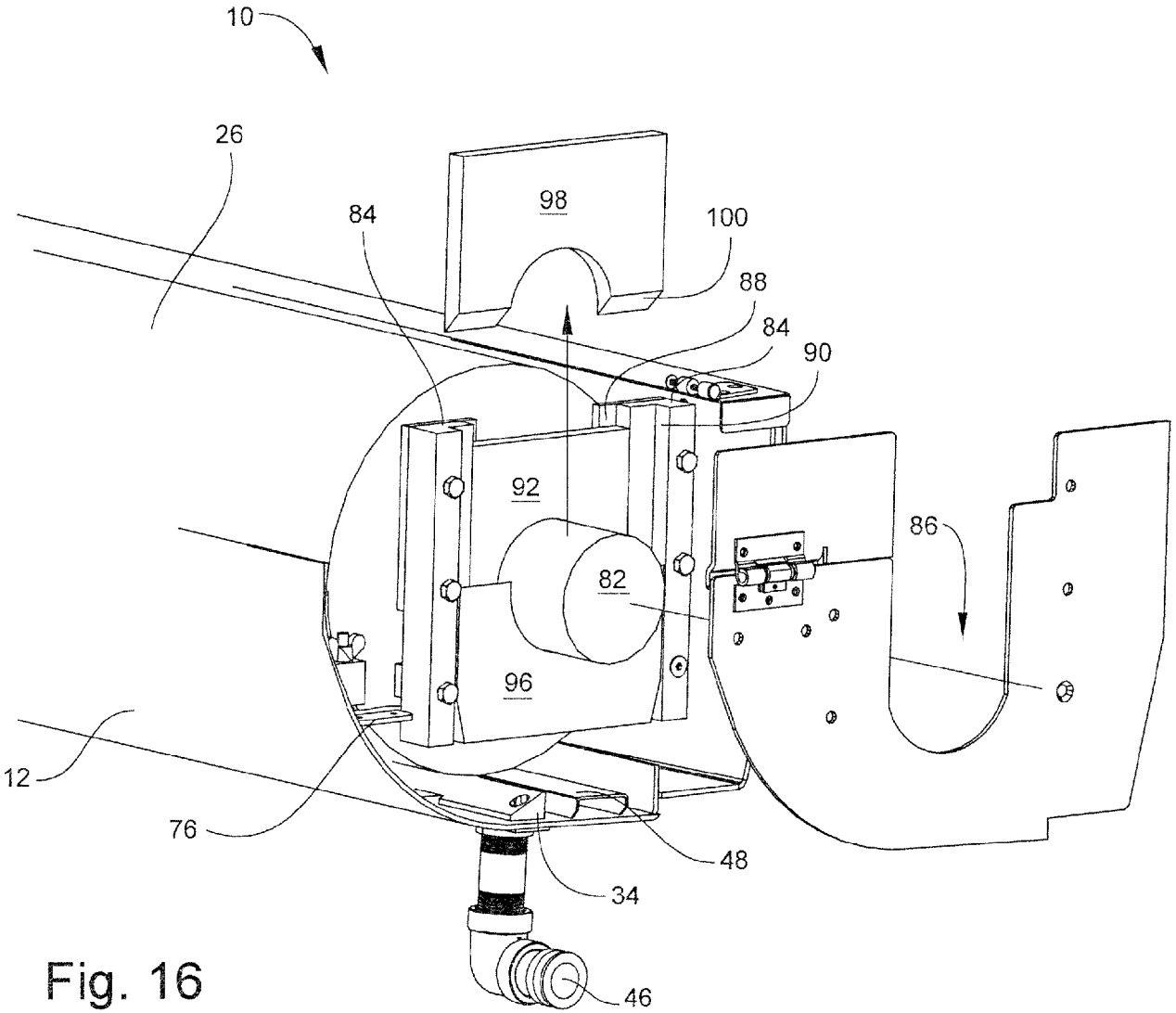
FIG. 16 is a partially disassembled view of the operator side of the ink pan system from the embodiment shown in FIG. 1.
Figure 17:
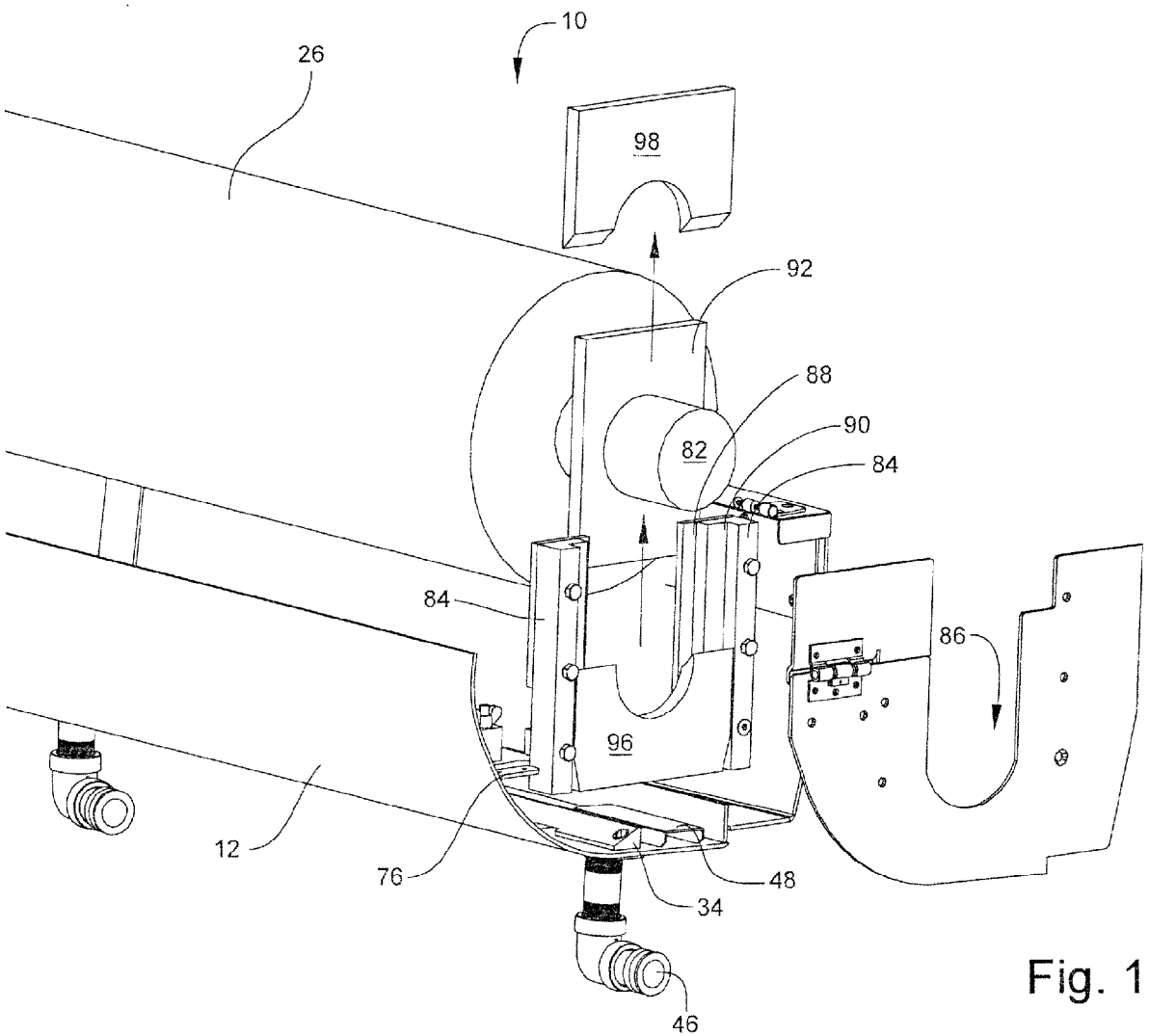
FIG. 17 is another partially disassembled view of the operator side of the ink pan system from the embodiment shown in FIG. 1.
Figure 18:
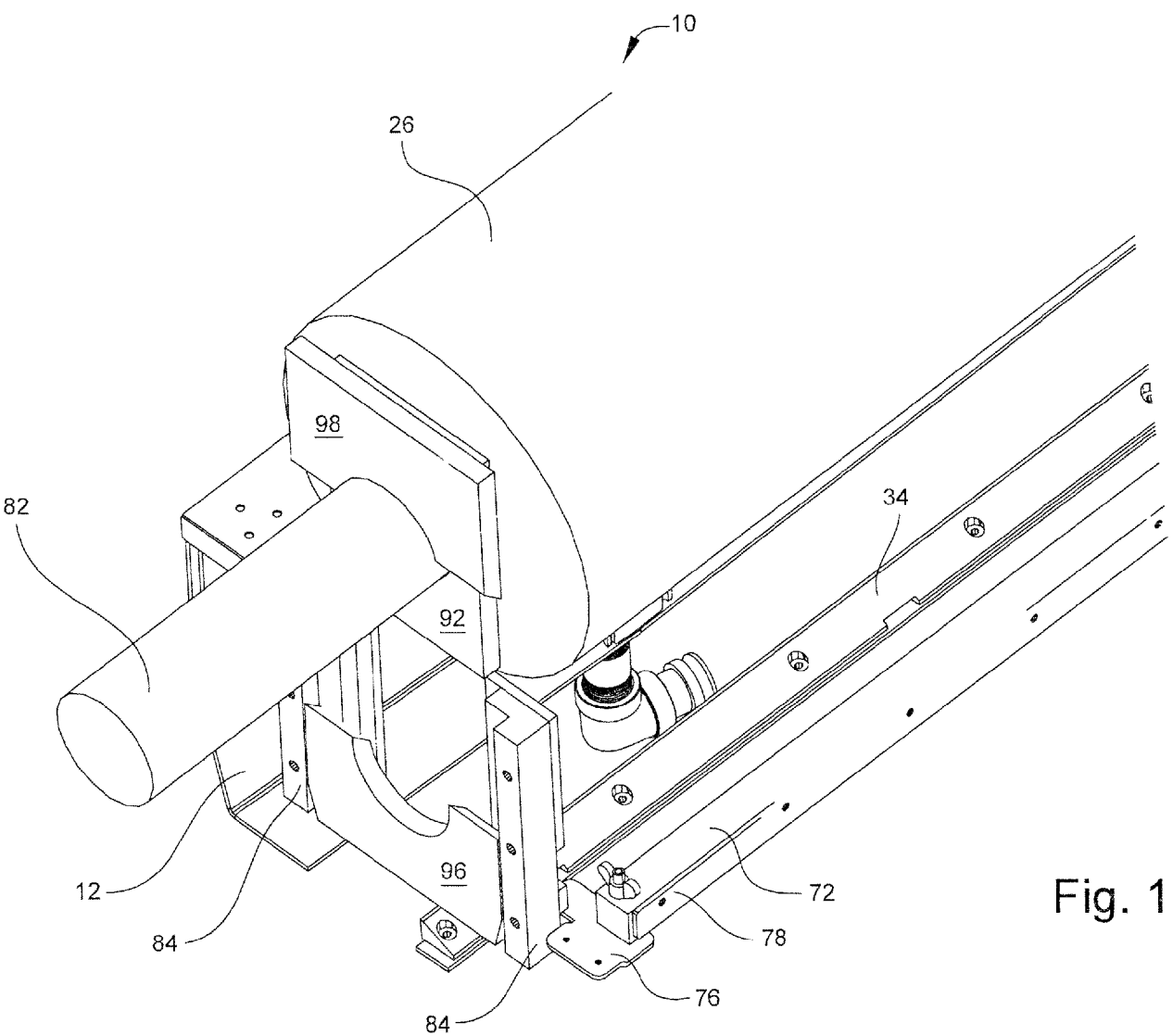
FIG. 18 is a partially disassembled view of the driver side of the ink pan system from the embodiment shown in FIG. 1.

Two journal port seals 80 may be included in ink pan system 10 (best shown in FIGS. 16-18). Journal port seals 80 may be for sealing the ends of reservoir 12 with the respective ends of journal 82 of gravure cylinder 26. Journal port seals 80 may be any device for sealing the ends of reservoir 12 with the respective ends of the journal 82 of gravure cylinder 26. Journal 82 of the instant invention extends outside of reservoir 12 on both ends. This requires reservoir 12 to have opening 86 on each end of reservoir 12. Each journal port seal 80 may include any sealing components. In one embodiment, each journal port seal 80 may include: a pair of multi-slotted brackets 84, an inner seal 92, and an outer seal 94.

A pair of multi-slotted brackets 84 may be included on each side of a pair of openings 86 on each end of reservoir 12 (best shown in FIGS. 16-18). Multi-slotted brackets 84 may be for providing a seal between the inner seal 92, the outer seal 94, and reservoir 12. Each multi-slotted bracket 84 may be attached to the sides of opening 86 in reservoir 12 by any means, including, but not limited to, a plurality of bolts. Each multi-slotted bracket 84 may include a first slot 88 and a second slot 90. First slot 88 may be adapted to receive an inner seal 92. Second slot 90 may be adapted to receive an outer seal 94.

Inner seal 92 may be included as part of journal port seal 80 on each end of reservoir 12 (best shown in FIGS. 16-18). Inner seal 92 may be for providing a first seal between the inside of reservoir 12 and journal 82. Inner seal 92 may be made of any material, including, but not limited to, a neoprene material. Inner seal 92 may be any shape, including, substantially rectangular. This rectangular shape may allow inner seal 92 to fit within first slot 88 of opposing multi-slotted brackets 84. Inner seal 92 may have a width that is 1 inch wider that outer seal 94.

Outer seal 94 may be included as part of journal port seal 80 on each end of reservoir 12 (best shown in FIGS. 16-18). Outer seal 94 may be for providing a second seal between the inside of reservoir 12 and journal 82. Outer seal 94 may be made of any material, including, but not limited to an ultra high molecular weight polyethylene seal. Outer seal 94 may be any shape, including, substantially rectangular. This rectangular shape may allow outer seal 94 to fit within second slot 90 of opposing multi-slotted brackets 84. Outer seal 94 may include any sealing components. In one embodiment, outer seal 94 may be a single seal. In another embodiment, outer seal 94 may include two pieces, a lower outer seal 96, and an upper outer seal 98. This two piece embodiment may allow journal 82 to be installed more easily into journal port seals 80. In this embodiment, lower outer seal 96 and upper outer seal 98 may connect together at an angle upward from reservoir 12, thereby forcing ink to travel upwards between the seals to exit reservoir 12. In this embodiment, a spring may be provided at the bottom of both outer seals for biasing the seals toward journal 82. This may allow for the accommodation of different size journals.

A pre-wipe bar 72 may be included in ink pan system 10 (best shown in FIGS. 11-15). Pre-wipe bar 72 may be for removing excess ink from gravure cylinder 26 before doctor blade 28. Pre-wipe bar 72 may be any device for removing excess ink from gravure cylinder 26 before doctor blade 28. Typically, during the rotation of gravure cylinder 26, the surface of the cylinder may draw up significantly more ink then is required to fill the engraved cells on the cylinder. This extra ink eventually forces an operator to put more pressure on the doctor blade, which in turn forces the doctor blade to bend away from the cylinder. This makes the doctor blade inoperable over time which causes print defects from unwanted, or un-wiped, ink transferring to the printing surface. In addition, the doctor blade's metering edge and the thin protective chrome plating on the cylinders surface both begin to wear. Furthermore, some of the excess ink that reaches the doctor blade migrates down the blade holder eventually dripping onto the substrate surface resulting in print defects. Some of this excess ink may also be drawn up by the cylinder from intake section 16 and splashed or slung off of the cylinder. Thus, pre-wipe bar 72 is used to remove some of this ink to increase the time that the doctor blade is operable. Pre-wipe bar 72 may be located anywhere between doctor blade 28 and vortex promoter 34. Pre-wipe bar 72 may be made of any material, including, but not limited to, being made of ultra high molecular weight polyethylene. In one embodiment, pre-wipe bar 72 may be a triangular cross-sectioned bar. This triangular cross-sectioned bar may have any dimensions, including, but not limited to, having dimensions of 1.25 inches×1.25 inches×1.7677 inches. Pre-wipe bar 72 may engage gravure cylinder 26 at any angle. In one embodiment, pre-wipe bar 72 may engage gravure cylinder 26 at approximately a 90 degree angle to its tangent. Pre-wipe bar 72 may extend the length of reservoir 12. Pre-wipe bar 72 may be attached to reservoir 12 by any means. In one embodiment, pre-wipe bar 72 may be attached to reservoir 12 at each end with a pair of side brackets 76 (see FIG. 13). In this embodiment, each side bracket 76 may include a side bracket slot 77. Side bracket slot 77 may be for allowing pre-wipe bar 72 to be adjustable thereby allowing pre-wipe bar 72 to move toward gravure cylinder 26 or away from the gravure cylinder 26, as needed. In this embodiment, because pre-wipe bar is only attached to reservoir 12 at its ends, pre-wipe bar 72 may include a reinforcement bar 78. Reinforcement bar 78 may be an L-shaped bar for reinforcing pre-wipe bar 72. Reinforcement bar 78 may be made of any material, including, but not limited to, being made of aluminum.

Doctor blade 28 may work with ink pan system 10. See FIGS. 2-3. Doctor blade 28 may remove the excess ink from gravure cylinder 26. Doctor blade 28 may be any device capable of removing the excess ink from gravure cylinder 26. Doctor blade 28 may be positioned so that the excess ink removed from gravure cylinder 26 falls into intake section 16. The improvement to doctor blade 28, over doctor blade 28*a* shown in the prior art (FIGS. 2-3) is the addition of angled doctor blade holder 102. A major challenge for a rotogravure printer is to present the doctor blade to the gravure cylinder so that contact is made at the standard process specification of 60 degrees to the tangent. This angle is optimal to maximize the life of the doctor blade and to allow the ink to roll back down into the intake section. Current blade holders typically clamp the blade sot that the blade extends from the holder at the same plane, 180 degrees, or at a slightly reduced angle. However, print station limitations restrict raising the blade holder, thus, preventing operators from raising the holder high enough to lower the blade to achieve the desired specification of 60 degrees to the tangent. A wide range of print defects eventually appear when operating a rotogravure print station when the blade contacts the cylinder under 60 degrees. This requires more downtime of the press to change blades and adds additional costs of the blades themselves. In addition, most blade holders are very heavy and difficult to change blades. The instant angled doctor blade holder 102 is designed to eliminate all of these problems.

An angled doctor blade holder 102 may be included with doctor blade 28. See FIGS. 19-23. Angled doctor blade holder 102 may be for allowing doctor blade 28 to be positioned on gravure cylinder 26 at an optimal 60 degree angle to its tangent. Previous designs of doctor blade holders did not allow for doctor blade 28 to be positioned on the gravure cylinder at an optimum angle of 60 degrees due to mechanical constraints. These mechanical constraints, like print station limitations, restricted raising the blade holder high enough to lower the blade to achieve the desired 60 degree angle. A wide range of print defects may eventually appear when operating a rotogravure print station when the doctor blade contacts the cylinder at an angle under 60 degrees to its tangent. These printing defects lead the operator to change doctor blades, which requires buying new blades and the press to be stopped, leading to downtime and additional added expenses. Angled doctor blade holder 102 may be made out of any material. In one embodiment, angled doctor blade holder may be made out of a light weight aircraft aluminum which is anodized to create a protective hard skin. As a result of this material, one person may handle the holder without potential physical strain. Angled doctor blade holder 102 may include any components for providing an angled doctor blade. In one embodiment, angled doctor blade holder 102 may include: an angled clamp platform 104, an ink diverter 106, a primary blade 108, a clamp plate 112, and a blade release clamp 114. In one embodiment, angled doctor blade holder 102 may also include a back-up blade 110.

Angled clamp platform 104 may be included in angled doctor blade holder 102. See FIGS. 19-23. Angled clamp platform 104 may provide a plain on which primary blade 108 may be positioned to contact gravure cylinder 26 at a 60 degree angle to its tangent at its initial setting. Angled clamp platform 104 may be any shape or size of angled platform with a plain positioned at a 60 degree angle to the tangent of the gravure cylinder. Angled clamp platform 104 may be beveled to the plain of the holder. In one embodiment, angled clamp platform 104 may include a series of posts. These posts may be for attaching clamp plate 112 via a series of notches in clamp plate 112. These posts may also be for providing a back position for primary blade 108 and back-up blade 110.

Ink diverter 106 may be included in angled doctor blade holder 102. See FIGS. 19-23. Ink diverter 106 may be for diverting ink back into intake section 16 of reservoir 12. Ink diverter 106 may be any device for diverting ink back into intake section 16. Ink diverter 106 may be positioned below angled clamp platform 104 for diverting ink back into said intake section 16. Ink diverter 106 may prevent ink from splashing out of reservoir 12. Ink diverter 106 may include side ink diverter and a bottom ink diverter.

Primary blade 108 may be included with angled doctor blade holder 102. See FIGS. 22-23. Primary blade 108 may be the first doctor blade used with angled doctor blade holder 102. Primary blade 108 may be any doctor blade known in the art. Primary blade 108 may be positioned on angled clamp platform 104 so that primary blade 108 contacts gravure cylinder 26 at a 60 degree angle to its tangent at initial setup. Primary blade 108 may have any width known in the art, including a width between 0.40 inches and 2.35 inches. Primary blade 108 may have any thickness known in the art, including, a thickness between 0.006 inches and 0.015 inches. Primary blade 108 may be made out of any material known in the art, including, but not limited to, being made out of a custom stainless steel that is micro refined with a particle size of 3μ+, and with an occurrence of 150,0000±/mμ$^2$. Primary blade 108 may also include any type of tip, including, but not limited to, a true radius tip, a bevel tip, or a lamella tip. Example blades are available from FLXON, Inc. of Charlotte, N.C. under the trademark Swedcut®.

Back-up blade 110 may also be included with angled doctor blade holder 102. Back-up blade 110 may before providing a back-up blade to primary blade 108. Back-up blade 110 may also be for providing support to the primary blade 108. Back-up blade 110 may be any device for providing a back-up blade to primary blade 108 and/or for providing support to primary blade 108. The back-up blade 110 may be any thickness known in the art, including, a thickness between 0.008 inches and 0.015 inches. Back-up blade 110 may be made out of any material known in the art, including, but not limited to, being made out of a custom stainless steel.

Clamp plate 112 may be included with angled doctor blade holder 102. See FIGS. 19-23. Clamp plate 112 may be for providing a surface to clamp primary blade 108 and back-up blade 110 on to angled clamp platform 104. Clamp plate 112 may be any surface capable of clamping primary blade 108 and back-up blade 110 on to angled clamp platform 104. Clamp plate 112 may be positioned over primary blade 108 and back-up blade 110. Clamp plate 112 may be thicker and narrower than normal clamp plates. In one embodiment, clamp plate 112 may include a series of notches adapted to receive a series of posts extending from angled clamp platform 104.

Blade release clamp 114 may be included with angled doctor blade holder 102. See FIGS. 21-23. Blade release clamp 114 may be for providing a mechanism for clamping primary blade 108 and back-up blade 10 between angled platform 104 and clamp plate 112. Blade release clamp 114 may be any device capable of clamping primary blade 108 and back-up blade 110 between angled platform 104 and clamp plate 112. Blade release clamp 114 may include backs stops that allow primary blade 108 and back-up blade 110 to be present relative to one another, including, but not limited to, 3 mm of separation. In one embodiment, blade release clamp 114 may include a cam 116. Cam 116 may be in operation with clamp plate 112 for easily and quickly clamping primary blade 108 and back-up blade 110 between angled platform 104 and clamp plate 112. A tool 118 may be included with cam 116 for easy and quick installation. Tool 118 may be for operating cam 116, whereby when tool 118 may be turned in one direction, cam 116 may tighten clamp plate 112 towards angled platform 104, and when tool 118 is turned in the opposite direction, cam 116 may loosen clamp plate 112 away from angled clamp platform 104. Tool 118 may include an ergonomic handle with a tapered base and a 90 degree cam interface rod. This 90 degree angle of the cam interface rod may allow the cam interface rod to be more easily replaced if broken or fractured.

A two-way pump 36 may be connected with intake port 46 and outtake port 50. See FIG. 1. Two-way pump 36 may be for moving the ink from an ink supply system 32 through intake port 46 into intake section 16 and for moving the ink from outtake section 18 through outtake port 50 into ink supply system 32. Two-way pump 36 may be any pump capable of moving the ink through two different conduits. Because of intake port 46 and outtake port 50 communicating with the bottom of reservoir 12, two-way pump 36 may require less power than the prior pump 36*a* (shown in FIG. 2), which requires the ink to be pumped over the sides of reservoir 12.

Ink supply system 32 may be for storing the ink and for preparing the ink for printing. See FIG. 1. Ink supply system 32 may be any device capable of storing the ink and preparing the ink for printing. Ink supply system 32 may be connected with intake port 46 and may be connected with outtake port 50. Ink supply system 32 may be any ink supply system (also known as ink carts) known in the art. Ink supply system 32 may include a filter. This filter may be any filter known in the art. In one embodiment, the filter may be a filter that removes particles of down to 50 microns, may include a capacity of 1.1 gallons, and have a 50 microns bag that can be changed out very quickly (approximately less than 30 seconds).

During printing, the ink may be moved through ink pan system 10. The ink first begins in ink supply system 32 where it may be prepared for printing. After being prepared for printing by ink supply system 32, the ink may be moved from ink supply system 32 into intake section 16 through intake port 46 by two-way pump 36. Gate 24 may be closed and the ink from intake section 16 may cascade over dam 14 into outtake section 18. The ink from outtake section 18 may be removed through outtake port 50 by two-way pump 36 to ink supply system 32. Ink supply system 32 may store the ink and prepare the ink again for printing.

While the ink may be moved into intake section 16 and gate 24 may be closed, dam 14 may maintain the ink in intake section 16 up to the height of dam 14. The ink in intake section 16 that exceeds the height of dam 14 may flow over dam 14 into outtake section 18. The part of the ink that flows over dam 14 may be the top layer of the ink. The top layer of the ink typically is where scumming, bubbling, and the swirling effect take place. Allowing this top layer of the ink to flow over dam 14 provides circulation in the top layer of the ink, which reduces the amount of scumming, bubbling, and the swirling effect that take place in front of gravure cylinder 26.

While the ink moves into outtake section 18 from intake section 16, the ink from outtake section 18 may be removed by two-way pump 36 through outtake port 50 and into ink supply system 32. Two-way pump 36 may allow the ink to be pumped directly to the ink supply system 32 and eliminates the need for a drain hose and ink sump, which may reduce the amount of parts needed to be cleaned. Thus ink pan system 10 may reduce the amount of man hours needed to clean parts after operation.

While the ink may be moved through ink pan system 10, gravure cylinder 26 may be rotated within intake section 16 and the ink may be picked up by gravure cylinder 26. After gravure cylinder 26 has been rotated within intake section 16, pre-wipe bar 72 may remove excess ink before it reaches doctor blade 28, which may fall back into intake section 16. Doctor blade 28 may then remove the remaining excess of the ink from gravure cylinder 26. This remaining excess ink may also fall back into intake section 16. Allowing the excess of the ink to be put back into ink pan system 10 for operation may reduce the amount of ink needed to operate the rotogravure printing press and may reduce the pump pressure needed to sustain the ink in ink pan system 10. The addition of pre-wipe bar 72 removing excess ink before it reaches doctor blade 28 may lengthen the life of doctor blade 28. This may reduce costs in replacement doctor blades and also reduce the downtime required to change blades.

After pre-wipe bar 72 and doctor blade 28 remove the excess ink, a printing surface 31 may be applied to the surface of gravure cylinder 26. See FIGS. 5 and 6. The printing surface 31 may be applied to the surface of gravure cylinder 26 by an impression roller 30. The application of the printing surface to the surface of the gravure cylinder 26 may result in a direct ink transfer from the surface of gravure cylinder 26 to the printing surface 31.

While gravure cylinder 26 may be spinning in intake section 16, vortex promoter 34 may cause turbulence between reservoir 12 and gravure cylinder 26. The ink may be applied more efficiently to gravure cylinder 26 when turbulence between reservoir 12 and gravure cylinder 26 is increased. More efficient application of the ink to gravure cylinder 26 may reduce the amount of ink needed to operate ink pan system 10. While this spinning process is taking place, ink may splash from gravure cylinder 26. Pan shrouding 40, journal port seals 80, and ink diverter 106 may prevent this splashing ink from exiting reservoir 12. This may reduce the amount of ink needed to fill the rotogravure printing press and may reduce the pump pressure needed to sustain the ink in ink pan system 10. In addition, because of journal port seals 80, the splashing ink may be prevented from entering the bearings of journal 82. In previous designs, the journal passes through a bearing housing that included at least some portion within the pan or reservoir. This allows ink to migrate into the bearing housing and eventually interfering with the function of the bearings. This requires additional housekeeping cost to clean, repair and replace the bearings. Furthermore, in this design, ink can migrate onto various areas of the trolley and onto the floor around the print station, requiring additional cleaning time. All of this requires additional downtime of the printing press. However, the current invention moves the bearing housing outside of reservoir 12 so that journal port seals 80 are between the ink and the bearing housing. Journal port seals 80 completely seal the journals 82 with reservoir 12, thereby preventing any ink from migrating into the bearing housing or outside of reservoir 12 via journals 82. Thus, journal port seals 80 may lead to the bearings lasting longer, which may reduce downtime and save costs of replacing the bearings. In addition, journal port seals 80 may eliminate any ink migrating out of reservoir 12 via journals 82, thus, saving ink and the costs and downtime of cleaning.

After printing, the ink may be removed and cleaned from ink pan system 10. Gate 24 may be opened to facilitate removal of the ink from ink pan system 10 and facilitate the cleaning of ink pan system 10. The ink from intake section 16 may empty into outtake section 18 when gate 24 may be opened. Plurality of channels 68 in vortex promoter 34 may allow any ink trapped above vortex promoter 34 to flow under vortex promoter 34 and out of gate 24. Emptying of reservoir 12 via first slope 52 and second slope 54 may allow all of the ink in ink pan system 10 to be emptied, which may reduce the amount of ink left in ink pan system 10 after operation. Ink pan system 10 may eliminate the need for a two pan system with an inner and an outer pan, which may reduce the amount of parts needed to be cleaned. Thus, ink pan system 10 may reduce the amount of man hours needed to clean parts after operation.

The ink from outtake section 18 may be removed by two-way pump 36 through outtake port 50 into ink supply system 32. Two-way pump 36 may provide a more efficient way of removing ink 8 from ink pan system 10 than just relying on the force of gravity. Providing a force greater than gravity for removing the ink from ink pan system 10 may reduce the amount of ink left in the rotogravure printing press after operation. Thus ink pan system 10 may reduce the amount of man hours needed to clean parts after operation.

After the ink is emptied from reservoir 12, two-way pump 36 may move a cleaning fluid through intake port 46 into ink pan system 10 and out of reservoir 12 through outtake port 50. The cleaning fluid may be for removing any ink remaining in ink pan system 10. Housing 48 may make it easier to direct cleaning solutions to be more efficient in cleaning the cylinder and the interior area surface of intake section 16. By moving a cleaning fluid through ink pan system 10, two-way pump 36 may reduce the amount of ink left in ink pan system 10 after operation. Thus, ink pan system 10 may reduce the amount of man hours needed to clean parts after operation.

In an alternative embodiment, an improved ink pan system for a single pan design of a rotogravure printing press having a reservoir with an open top, and a doctor blade positioned over the intake section of said reservoir, wherein the improvement may comprise: said reservoir having pan shrouding on the opposite side of said doctor blade over said outtake section, where said reservoir enclosing a substantial portion of the gravure cylinder. Said reservoir may enclose greater than 40% of the gravure cylinder, greater than 70% of the gravure cylinder, or approximately 90% of the gravure cylinder. Said pan shrouding may include a dam side shrouding and a pair of side flaps, each side flap being positioned over an end of said reservoir, said dam side shrouding being an L-shaped bracket attached to the top of said reservoir over said outtake section, said dam side shrouding extending the length of said reservoir over said outtake section, and each said side flap extending over said journal port seals and including a hinged portion allowing said journal port seals to be inserted and removed.

In another alternative embodiment, an improved ink pan system for a single pan design of a rotogravure printing press having a reservoir with an open top, a dam within said reservoir dividing said reservoir into an intake section where ink is contained for transfer to the gravure cylinder and an outtake section where ink is drained from the pan, and a gate within said dam having an open position and a closed position, wherein the improvement may comprise: an intake port through the bottom of said intake section; an outtake port through the bottom of said outtake section; and a two-way pump communicating with said intake port and said outtake port; whereby, the improvement reducing the pump pressure required of said two-way pump. Said intake port may comprise: a circular cross-section having a diameter of approximately 1 inch; a housing positioned directly over said intake port adapted for preventing surging of ink into said intake section from said intake port; said housing having a rectangular cross-section having a height of approximately 0.5 inches, a width of approximately 1.5 inches, and a length of approximately 3 inches; where said intake port being located approximate to the drive side of the gravure cylinder and approximate to said dam. Said outtake port may comprise: a circular cross-section having a diameter of approximately 1 inch; where said outtake port being located approximate to the operator side of the gravure cylinder and approximate to said gate.

In yet another alternative embodiment, an improved ink pan system for a single pan design of a rotogravure printing press having a reservoir with an open top, a dam within said reservoir dividing said reservoir into an intake section where ink is contained for transfer to the gravure cylinder and an outtake section where ink is drained from the pan, a gate within said dam having an open position and a closed position, and a vortex promoter located within said reservoir for promoting ink transfer to the gravure cylinder, wherein the improvement may comprise: a plurality of channels through said vortex promoter adapted for allowing ink to flow through said vortex promoter towards said outtake section, said plurality of channels providing better drainage of said intake section. Said plurality of channels may comprise: a plurality of groves machined into the bottom of said vortex promoter having: a height being approximately 0.125 inches; and a spacing between each said grove being no less than 6 inches. The ink pan system may further comprise: an intake port through the bottom of said intake section; an outtake port through the bottom of said outtake section; said intake section having a bottom with a first slope and said outtake section having a bottom with a second slope; said first slope being toward said outtake section; and said second slope being toward said outtake port from both sides. Said first slope may have a slope of at least 2 degrees as it approaches said vortex promoter.

In yet another embodiment of an improved ink pan system for a single pan design of a rotogravure printing press having a reservoir with an open top, a dam within said reservoir dividing said reservoir into an intake section where ink is contained for transfer to the gravure cylinder and an outtake section where ink is drained from the pan, and a gate within said dam having an open position and a closed position, wherein the improvement may comprise: a dam gate release lever connected to said gate and extending outside of said reservoir, said dam gate release lever being for opening and closing said gate from outside of said reservoir. Said dam gate release lever may have a locking means for locking said gate in the open position, and a stopping mechanism for preventing said gate from being pulled out of said dam. Said locking means and said stopping mechanism may be a wing nut mechanism inserted through a slot in said dam gate release lever and attached to the top of said reservoir. Said stopping mechanism may also comprise: a closed slot in said dam; and a rivet extending out from said gate; where said rivet being inserted into said slot.

In yet another embodiment, an improved ink pan system for a single pan design of a rotogravure printing press having a reservoir with an open top, a dam within said reservoir dividing said reservoir into an intake section where ink is contained for transfer to the gravure cylinder and an outtake section where ink is drained from the pan, a gate within said dam having an open position and a closed position, a vortex promoter located within said reservoir for promoting ink transfer to the gravure cylinder, and a doctor blade positioned over the intake section of said reservoir, wherein the improvement comprising: a pre-wipe bar for a rotogravure printing press comprising: a triangular cross-sectioned bar being located between said doctor blade and said vortex promoter adapted for removing excess ink from the gravure cylinder before it reaches said doctor blade; said triangular cross-sectioned bar engaging said gravure cylinder at approximately a 90 degree angle to its tangent; and said triangular cross-sectioned bar extending the length of said reservoir. Said triangular cross-sectioned bar may have dimensions of 1.25 inches by 1.25 inches by 1.7677 inches. Said pre-wipe bar may be attached to said reservoir at each end of said reservoir with side brackets; said side brackets being adjustable for allowing said pre-wipe bar to move toward the gravure cylinder or away from the gravure cylinder. The ink pan system may further comprise a reinforcement bar being made of aluminum, where said reinforcement bar being an L-shaped bar.

The instant invention may be embodied in other forms without departing from the spirit and the essential attributes thereof, and, accordingly, reference should be made to the appended claims, rather than to the foregoing specification, as indicated in the scope of the invention.

I claim:

1. An improved ink pan system for a single pan design of a rotogravure printing press having a reservoir with an open top, a dam within said reservoir dividing said reservoir into an intake section where ink is contained for transfer to a gravure cylinder and an outtake section where ink is drained from a pan, a gate within said dam having an open position and a closed position, a vortex promoter located within said reservoir for promoting ink transfer to the gravure cylinder, and a doctor blade positioned over the intake section of said reservoir, wherein the improvement comprising:

said reservoir having pan shrouding on the opposite side of said doctor blade over said outtake section, where said reservoir enclosing a substantial portion of the gravure cylinder;

an intake port through the bottom of said intake section;

an outtake port through the bottom of said outtake section;

said intake section having a bottom with a first slope and said outtake section having a bottom with a second slope;

said first slope being toward said outtake section and said vortex promoter;

said second slope being toward said outtake port from both sides;

a dam gate release lever connected to said gate and extending outside of said reservoir, said dam gate release lever being for opening and closing said gate from outside of said reservoir;

a plurality of channels through said vortex promoter adapted for allowing ink to flow through said vortex promoter towards said outtake section;

a pre-wipe bar located between said doctor blade and said vortex promoter adapted for removing excess ink from the gravure cylinder before it reaches said doctor blade;

two journal port seals located on each end of the gravure cylinder, each of said journal port seals being adapted for sealing a journal of the gravure cylinder with the ends of said reservoir; and an angled doctor blade holder.

2. The ink pan system of claim 1 where said reservoir enclosing greater than 40% of the gravure cylinder.

3. The ink pan system of claim 1 where said reservoir enclosing greater than 70% of the gravure cylinder.

4. The ink pan system of claim 1 where said reservoir enclosing approximately 90% of the gravure cylinder.

5. The ink pan system of claim 1 where said pan shrouding including a dam side shrouding and a pair of side flaps, each side flap being positioned over an end of said reservoir, said dam side shrouding being a bracket attached to the top of said reservoir over said outtake section, said dam side shrouding extending the length of said reservoir over said outtake section, and each said side flap extending over said journal port seals and including a hinged portion allowing said journal port seals to be inserted and removed.

6. The ink pan system of claim 1 where said first slope having a slope of at least 2 degrees as it approaches said vortex promoter.

7. The ink pan system of claim 1 where said intake port comprising:

a circular cross-section having a diameter of approximately 1 inch;

a housing positioned directly over said intake port adapted for preventing surging of ink into said intake section from said intake port;

said housing having a rectangular cross-section having a height of approximately 0.5 inches, a width of approximately 1.5 inches, and a length of approximately 3 inches;

where said intake port being located approximate to the drive side of the gravure cylinder and approximate to said dam.

8. The ink pan system of claim 1 where said outtake port comprising:

a circular cross-section having a diameter of approximately 1 inch;

where said outtake port being located approximate to the operator side of the gravure cylinder and approximate to said gate.

9. The ink pan system of claim 1 where said dam gate release lever including a locking means for locking said gate in the open position, said locking means comprising:

a wing nut mechanism inserted through a slot in said dam gate release lever and attached to the top of said reservoir.

10. The ink pan system of claim 9 where said gate having a stopping mechanism for preventing said gate from being pulled out of said dam, said stopping mechanism being said wing nut mechanism.

11. The ink pan system of claim 1 where said gate having a stopping mechanism for preventing said gate from being pulled out of said dam, said stopping mechanism comprising:

a closed slot in said dam; and a rivet extending out from said gate;

where said rivet being inserted into said slot.

12. The ink pan system of claim 1 where said plurality of channels comprising:

a plurality of grooves machined into the bottom of said vortex promoter having:

a height being approximately 0.125 inches; and a spacing between each said grove being no less than 6 inches.

13. The ink pan system of claim 1 where said pre-wipe bar comprising:

a triangular cross-sectioned bar having dimensions of 1.25 inches by 1.25 inches by 1.7677 inches;

said triangular cross-sectioned bar engaging said gravure cylinder at approximately a 90 degree angle to its tangent;

said pre-wipe bar extending the length of said reservoir;

said pre-wipe bar being attached to said reservoir at each end of said reservoir with side brackets;

said side brackets being adjustable for allowing said pre-wipe bar to move toward the gravure cylinder or away from the gravure cylinder;

said pre-wipe bar being made of ultra high molecular weight polyethylene; and said pre-wipe bar including a reinforcement bar being made of aluminum, where said reinforcement bar being an L-shaped bar.

14. The ink pan system of claim 1 where each of said journal port seals comprising:

a pair of multi slotted brackets attached to both sides of an opening in said reservoir, each of said multi slotted brackets including:

a first slot adapted to receive an inner seal; and a second slot adapted to receive an outer seal;

said inner seal being a neoprene seal; and said outer seal being an ultra high molecular weight polyethylene seal.

15. The ink pan system of claim 14 where said outer seal including:

a lower outer seal; and an upper outer seal;

where said lower outer seal and said upper outer seal connect together at an angle upward from said reservoir.

16. The ink pan system of claim 1 where said angled doctor blade holder comprising:

an angled clamp platform being angled to the plain of the gravure cylinder at a 60 degree angle thereby allowing the doctor blade to be positioned on the gravure cylinder at a 60 degree angle;

an ink diverter positioned below said angled clamp platform adapted for diverting ink back into said intake section;

a primary blade positioned on said angled clamp platform;

a back-up blade positioned over said primary blade;

a clamp plate positioned over said primary blade and said back-up blade; and a blade release clamp, said blade release clamp clamping said back-up blade and said primary blade between said angled platform and said clamp plate;

said blade release clamp including a cam in operation with said clamp plate and a tool for operating said cam.

* * * * *